US008063296B2

(12) United States Patent
Copeland et al.

(10) Patent No.: US 8,063,296 B2
(45) Date of Patent: Nov. 22, 2011

(54) APPARATUS FOR PERCUSSIVE HARMONIC MUSICAL SYNTHESIS UTILIZING MIDI TECHNOLOGY

(76) Inventors: Brian R. Copeland, San Fernando (TT); Marcel Byron, Tunapuna (TT); Earle Philip, Tunapuna (TT); Keith Maynard, Port of Spain (TT)

( * ) Notice: Subject to any disclaimer, the term of this patent is extended or adjusted under 35 U.S.C. 154(b) by 0 days.

(21) Appl. No.: 12/438,980

(22) PCT Filed: Oct. 26, 2007

(86) PCT No.: PCT/TT2007/000002

§ 371 (c)(1),
(2), (4) Date: Mar. 30, 2010

(87) PCT Pub. No.: WO2009/054821

PCT Pub. Date: Apr. 30, 2009

(65) Prior Publication Data

US 2010/0180755 A1 Jul. 22, 2010

(51) Int. Cl.

| | |
|---|---|
| ***G10H 7/00*** | (2006.01) |
| ***G10H 1/00*** | (2006.01) |
| ***A63J 17/00*** | (2006.01) |
| ***A63J 5/10*** | (2006.01) |

(52) U.S. Cl. ..... 84/645; 84/464 R; 84/464 A; 84/411 R; 84/421

(58) Field of Classification Search ..... 84/645, 84/464 R, 464 A, 411 R, 421
See application file for complete search history.

(56) References Cited

U.S. PATENT DOCUMENTS

| | | | | |
|---|---|---|---|---|
| 3,956,959 | A | 5/1976 | Ebihara et al. | |
| 4,479,412 | A | 10/1984 | Klynas | |
| 4,679,479 | A | 7/1987 | Koyamato | |
| 4,700,602 | A | 10/1987 | Bozzio | |
| 4,781,097 | A | 11/1988 | Uchiyama et al. | |
| 4,892,023 | A | 1/1990 | Takeuchi et al. | |
| D319,650 | S | 9/1991 | Hart | |
| 5,076,131 | A | 12/1991 | Patterson | |
| 5,115,706 | A | 5/1992 | Aluisi | |
| 5,434,350 | A | 7/1995 | Haney et al. | |
| 5,502,274 | A | 3/1996 | Hotz | |
| 5,973,247 | A | 10/1999 | Matthews | |
| 6,212,772 | B1 | 4/2001 | Whitmyre et al. | |
| 7,030,305 | B1 | 4/2006 | Cupid | |
| 7,696,421 | B1 * | 4/2010 | Charles | 84/411 R |
| 7,750,220 | B2 * | 7/2010 | Copeland | 84/411 R |
| 7,842,872 | B2 * | 11/2010 | Charles | 84/483.2 |
| 7,842,877 | B2 * | 11/2010 | Charles | 84/615 |

OTHER PUBLICATIONS

International Search Report and Written Opinion dated Apr. 27, 2009 issued in PCT Application No. PCT/TT2007/000002, 9 pages.

(Continued)

*Primary Examiner* — Jeffrey Donels
(74) *Attorney, Agent, or Firm* — Daniels Patent Law PLLC; Scott A. Daniels

(57) ABSTRACT

An Apparatus for Percussive Harmonic Musical Synthesis (APHAMS) which facilitates state-of-the-art musical expression, through generation of melodic sound, bearing well defined tone and note pitch, by the striking of uniquely configured multiple note activitation trigger mechanism surfaces, termed muzi-pads, with an appropriately sized mallet, stick, or other such similar playing implement, for the generation of a desired note, by a given MIDI device and which provides an enhanced emulation of the traditional tenor steelpan, in its interface with the player.

21 Claims, 10 Drawing Sheets

OTHER PUBLICATIONS

Kirn, Mandala Multi-Zone Digital Drum, create digital music, http://createdigitalmusic.com/2006/05/19/mandala-multi-zone-digital-drum/ downloaded from internet Jan. 16, 2009, 10 pages.
MidAir—Wireless MIDI Transmitter and Receiver System, M-Audio—A part of Avid, http://www.m-audio.com/produts/en_us/MidAir.html downloaded from internet Jan. 16, 2009, 2 pages.
panKAT The World's First Midi Pan Percussion Controller, PanKAT—MIDI Steel Drum Controller, http://www.alternatemode.com/pankat.shtml downloaded from internet Jan. 16, 2009, 2 pages.
panKAT manual2_05, Jan. 16, 2009, 78 pages.
World's First MIDI Steel Drum Percussion Controller, Synthtopia, http://www.synthtopia.com/content/2007/03/14/worlds-first-midi-steel-drum-percussion-controller/ downloaded from internet Jan. 16, 2009, 8 pages.
Pan Technology: Visions for the 21st Century; APPETT Journal, vol. 32, No. I, Apr. 1999, pp. 27-33.

* cited by examiner

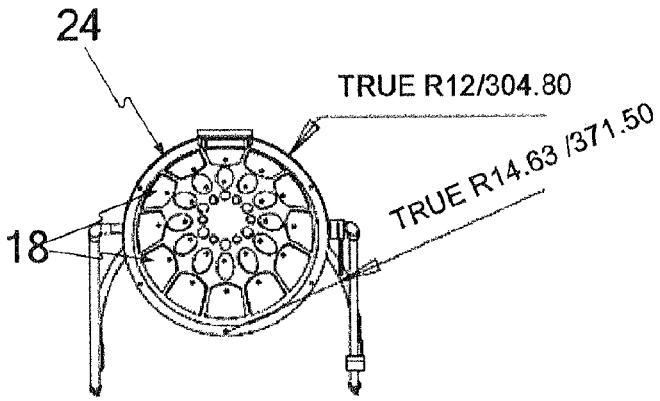
Fig. 3a
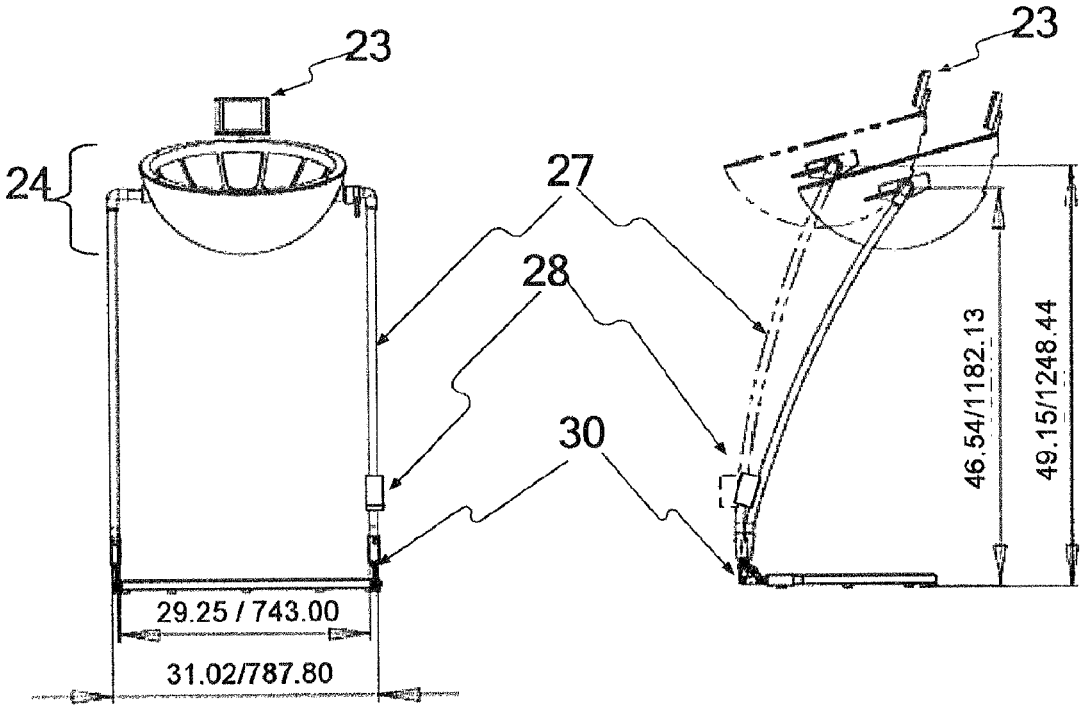
Fig. 3b
Fig. 3c
Fig. 3

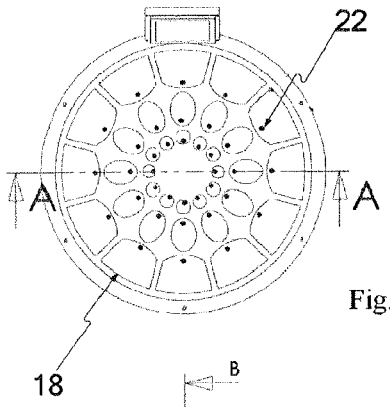
Fig. 4a
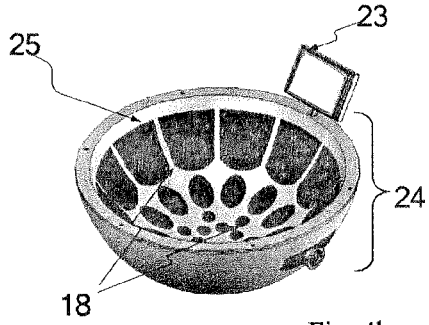
Fig. 4b
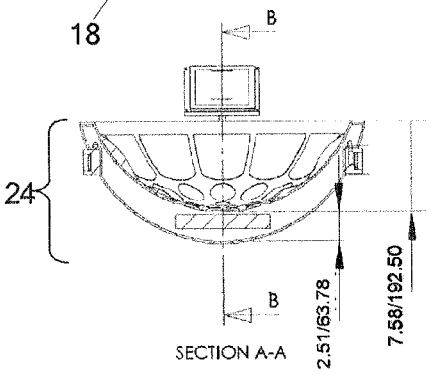
Fig. 4c
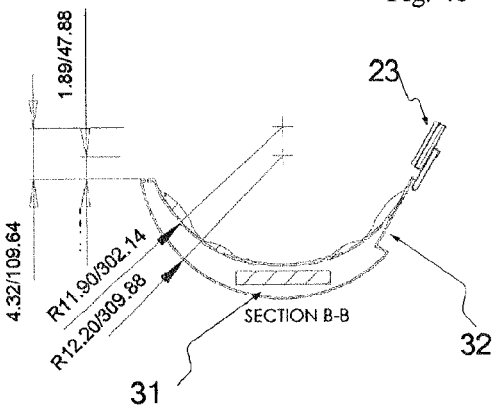
Fig. 4d
Fig. 4

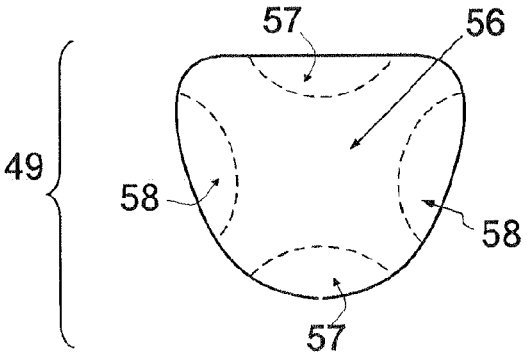
Fig. 7a
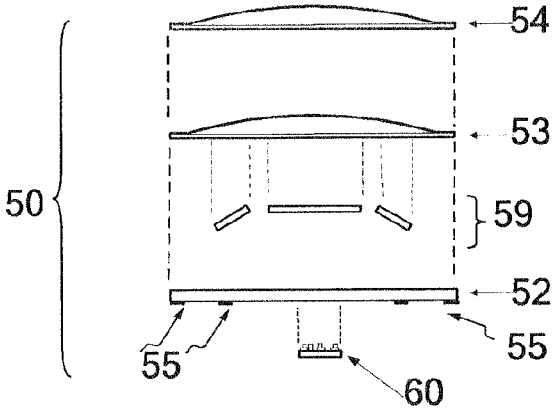
Fig. 7b
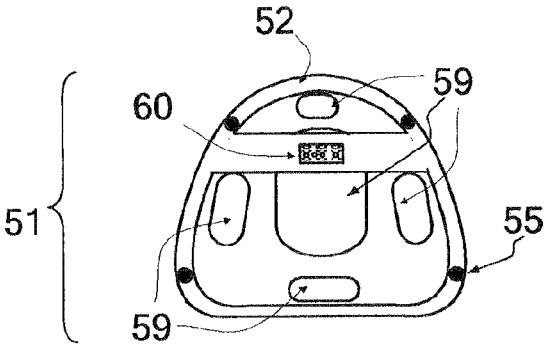
Fig. 7c
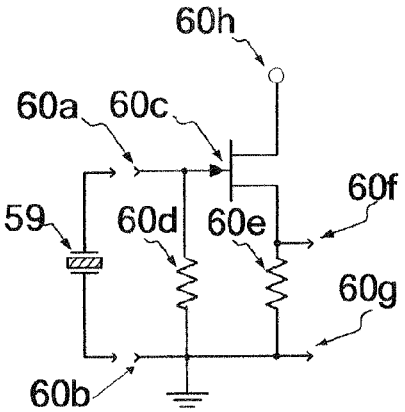
Fig. 7d
Fig 7

APPARATUS FOR PERCUSSIVE HARMONIC MUSICAL SYNTHESIS UTILIZING MIDI TECHNOLOGY

BACKGROUND OF THE INVENTION

1. Technical Field of the Invention

The present invention relates to the field of electronic musical instruments being an Apparatus for Percussive Harmonic Musical Synthesis (APHAMS) which targets the percussive melodic mode of performance, through emulation of the physical layout and feel of tenor steelpan musical instruments and which utilizes MIDI technology for the synthesis of a range of musical sound generation.

2. Description of the Prior Art

In terms of their bearing and influence on the development of the apparatus of the present invention, drums, steelpans and general percussive devices, which provide for internal synthesis using internal electronics and/or external synthesis using the MIDI protocol, are known in the prior art.

In relation to the apparatus of the present invention, despite its novelty and appeal, the traditional acoustic steelpan instrument suffers from several disadvantages and apparent drawbacks.

First, as evidenced by the need to implement many ranges on multiple drums, it is virtually impossible presently, to manufacture a steelpan that is able to cover the widest possible musical range, from bass to soprano range, on a single drum. This limitation is imposed by the physical size of the notes and the size of drums in use. In particular, due to the fact that note sizes increase dramatically for notes lower down on the musical scale, the arrangement of notes that follows the musical cycle of 4ths and 5ths is only possible on the tenor steelpan which uses a single drum to realize the highest musical range.

A direct consequence of this limitation is the fact that, except for the higher ranges that utilize up to two or three drums, the instrument is not easily portable.

Another significant disadvantage stems from the difficulty in retuning the instrument as tuning is generally done by an expert. Tuning may be necessary after extensive use, use of excessive force in playing the instrument, or a change in temperature. The production of steelpans that can deliver true and natural sound, over a wide musical range and that do not require the need for a tuning expert, to continuously keep the instrument tuned for optimized sound is very desirable.

Finally, although the instrument has introduced a new modality of performance whereby players can produce melodic sounds by striking notes on a single metallic surface, quite apart from the subtle changes in timbre that occur by variation in the manner in which notes are struck and where they are struck, the traditional instrument does not have the flexibility which would allow for rapid changes in timbre or voice.

As they have had bearing or influence upon the proactive evolution of the apparatus of the present invention, there are a variety of instruments, including electronic drums which utilize the universal MIDI standard. The electronic keyboard percussion instrument of U.S. Pat. No. 4,892,023 to Takeuchi et al, uses an arrangement of plates arranged in similar fashion to a standard keyboard. The said instrument is played like a xylophone. The output of sensors attached to the plates is used to trigger the generation of synthesized tones corresponding to the designated notes. The said design also facilitates wired connection to a MIDI network, so as to extend the range of voices which can be accessed.

However, the aforementioned electronic keyboard percussion instrument does not support the 4ths and 5ths note arrangement, nor does it allow for other variations in the note arrangement, apart from transposition. In addition it does not support ten (10)-note polyphony, nor does the physical arrangement of plates facilitate finger play. Finally, the said instrument does not facilitate wireless capability without external devices.

Electronic drum instruments, such as those described in U.S. Pat. Nos. 3,956,959 to Ebihara et al, 4,781,097 to Uchiyama et al, 4,479,412 to Klynas, 5,434,350 to Haney and 5,076,131 to Patterson, utilize pressure sensitive pad arrays and electronics to generate MIDI output, for tone generation, or for direct internal sound synthesis.

These heretofore mentioned electronic drum instruments have been designed for the primary purpose of synthesizing acoustic drums. As such, the number of pads available is limited, usually to no more than twelve (12), i.e. a single octave. Moreover, as a further consequence of the original design intent for drum synthesis, the size, arrangement and other physical attributes of the pads do not facilitate an ergonomic, musically intuitive note arrangement for the performance of melodic music.

As they relate to the apparatus of the present invention, the use of electronic drums is well known in the prior art. For example, U.S. Pat. No. 4,700,602 to Bozzio, discloses an electronic drum having multiple sound sources with rapidly detachable striking elements and piezoelectric transducers. However, the said invention of the aforementioned patent does not utilise electronic synthesizers to deliver the natural sound of a steelpan. Furthermore, said patent does not disclose the mixing of other musical instruments with the sound of the steelpan.

U.S. Pat. No. 4,679,479 to Koyamato discloses an electronic drum, which uses a single detection element mounted on the base layer of the drum to detect the striking of the drum surface. However, the invention of this said patent does not use electronic synthesizers to deliver the natural sound of a steelpan. Furthermore, this patent does not disclose the mixing of other musical instruments with the sound of the steelpan.

Also, U.S. Pat. Design No. D319,650 to hart discloses the design of an electronic drum. However, the invention disclosed in this said patent has a single striking surface and does not use electronic synthesizers to deliver the natural sound of a steelpan. Furthermore, this patent does not disclose the mixing of other musical instruments with the sound of the steelpan.

Finally, U.S. Pat. No. 5,502,274 to Ilotz, U.S. Pat. No. 6,212,772 to Whitmyre et al., and U.S. Pat. No. 5,973,247 to Matthews all disclose instruments which may be of general interest and pertinent to the construction and design of the apparatus of the present invention.

U.S. Pat. No. 5,502,274 to Ilotz discloses an electronic musical instrument for playing along with pre-recorded music. However, this instrument does not concentrate on generating the true and natural sound of the steelpan.

U.S. Pat. No. 6,212,772 to Whitmyre, discloses a Caribbean steelpan. However, this said instrument does not disclose a device which uses electronics to emulate the traditional steelpan.

U.S. Pat. No. 5,973,247 to Matthews, discloses a portable steel drum and carrier. Here again, this instrument does not disclose a device that uses electronics to emulate the traditional acoustic steelpan.

U.S. Pat. No. 7,030,305 B1 to Cupid, employs a pressure-sensitive pad matrix in an ergonomic framework modeled along the lines of the now generic conventional acoustic steelpan. However, while said aforementioned invention caters for the electronic simulation of all existing acoustic steelpan ranges from bass to high tenor, said aforementioned invention does not allow for the pressure-sensitive pad matrix to be arbitrarily configured.

As such, while said design caters for the electronic simulation of all existing acoustic steelpan ranges from bass to high tenor, by replicating the physical form of these instruments, nonetheless, said invention, requires the use of two, three, or even six, separate playing surfaces and said invention does not facilitate full emulation of the steelpan, by generating timbre variations, when different parts of the pressure-sensitive pads are struck.

In particular, while said aforementioned invention supports the 4ths and 5ths note arrangement, said invention does not facilitate arbitrary variations in the note arrangement, neither is there support for ten (10)-note polyphony, nor does the physical design of the pads facilitate finger play. Furthermore, said aforementioned invention does not facilitate wireless MIDI capability without external devices, nor is there allowance for control of devices on a MIDI network. Said aforementioned invention allows only for synthesis of the various ranges of steelpan, does not emphasize the synthesis of a wide variety of voices and supports only twenty-eight (28) notes.

In conclusion therefore, the said hereinbefore mentioned invention, does not support simultaneous synthesis of multiple voices and it does not facilitate full emulation of the steelpan instrument, by generating timbre variations when different parts of the pressure-sensitive pads are struck.

In view of the foregoing demonstrated disadvantages inherent in the known types of traditional generic acoustic steelpans, electronic synthesized steelpans, electronic keyboard percussive instruments and other such similar instruments now present in the prior art, the apparatus of the present invention provides an appropriate innovative melodic apparatus, which overcomes the above-mentioned disadvantages and more, as well as the previously stated given drawbacks of the prior art.

As such, the general purpose of the present invention, which will be described subsequently in greater detail, is to provide a new and improved melodic apparatus, which has all the stated advantages of the prior art mentioned heretofore and many other novel features which result in a melodic apparatus which is not anticipated, rendered obvious, suggested, or even implied by the prior art, either alone, or in any given combination thereof.

SUMMARY OF THE INVENTION

The apparatus of the present invention facilitates the generation of musical tones when played percussively through the use of the well established MIDI technology for the synthesis of a range of music voices, using external or internal MIDI sound modules.

For the apparatus of the present invention, there are given three (3) main components namely: (a) the Main Assembly, (b) the control & display console and (c) the mounting stand.

The main assembly of said apparatus of the present invention is a sealed enclosure that embodies and supports the electronics which provide for the functionality of said apparatus.

At the top of the main assembly is the playing surface that supports an array of muzi-pads. Said muzi-pads are specially designed surfaces that include electronic sensors that trigger the generation of sound when each muzi-pad is struck with a light stick, or mallet, or the fingers.

Said sound is actually produced by an internal or external amplification system that takes input generated by internal or external synthesizer modules, connected to the apparatus of the current invention, through a MIDI network and can be a musical note, the sound of a percussion instrument or a special effects sound, as may be determined by the player, through use of the customization features provided by the MIDI software.

Said muzi-pads are arranged in an array of concentric rings, there being twelve (12) muzi-pads in each such ring, typically representing the twelve (12) notes in a musical octave. Said array is comprised of three (3) or four (4) such rings, thus covering as many as four (4) musical octaves.

While the current invention allows the user to customize the sound generated by each muzi-pad, the apparatus of the present invention uses a default note assignment whereby the aforementioned muzi-pads are arranged in concentric rings, having 12 notes per ring, with note pitches following the cycle of musical 4ths and 5ths along each ring. Note pitches increase by one octave per ring, as one moves along a radial line towards the centre of the playing surface. This format presents the user with a single interface that is familiar to accomplished musicians and is easily learnt.

Physical attributes of said muzi-pads are varied so as to allow quick and easy identification of notes.

Said muzi-pads are also associated with light emitting devices affixed in close proximity to or directly upon the muzi-pads, one light emitting device per muzi-pad, which provides a visual cue, to indicate which muzi-pads are to be struck in accordance with a musical piece as dictated by a given MIDI sequence. The total collection of all said light emitting devices thus located on the playing surface form a Light Emitting Device Array (LEDA) which by its described function facilitates tuition.

Said playing surface is typically of a concave circular shape, thus facilitating ease of play in the percussive mode. The geometry of the playing surface and said muzi-pads can be varied to accommodate different stylistic, performance and ergonomic considerations. Variation in touch sensitivity allows said instrument to be played with fingers.

The control & display console provides an interactive human-machine interface, that allows the user to select one or more features as may be desired. It is mounted upon the rim of the playing surface for easy access during performance.

Sound generation is effected through internal or external sound synthesis modules connected to an amplification system. Communication to all modules is by way of the MIDI protocol. Internal synthesis is facilitated by implementation of tone banks on standard removable memory, such as Secure Digital (SD) or Smart Media (SM) cards, or on a USB memory key.

Said internal synthesis facilitates operation in a standalone mode, without need for an external sound module. Internal synthesis allows the player a level of customization in the voices that can be accessed from the apparatus of the present invention. A separate facility is provided, to allow players to create their own tone banks by sampling an existing instrument, or for creating completely new sounds.

The customizable tone feature of the apparatus of the present invention, provides for the accurate synthesis of the steelpan, including all of its nuances, through either physical model synthesis or wave table synthesis.

The present invention also incorporates a playback and recording facility which facilitates the capture, storage and replay of MIDI sequences generated by the player for customizable ready made accompaniment. The facility supports, variable tempo and a metronome. In addition, the present invention allows the itinerant player to download MIDI files through the I/O Ports for storage in the Song Bank.

The architecture of the logic of the apparatus of the present invention, supports ten-note polyphony, allowing the palmist to use his fingers for playing if he so desires.

It is a prime object of the apparatus of the present invention, to optimize the ability of any itinerant player or given user, to access the full benefits of modern digital electronic, communication and computer technology to enhance the performance of players through built in capabilities of the apparatus to generate, store and transmit sound to external sources and to access remote sources for music generation material, including MIDI sequences and new tones.

Therefore, it is an object of the present invention, to provide a vastly improved apparatus, in which a variety of features can be preset for rapid re-configuration of the present invention during a performance, this being facilitated by user-programmable input controls, to which the desired configurations may be assigned.

A further object of the apparatus of the present invention is the support of the 4ths and 5ths note arrangement, as well as the facilitation of arbitrary variations in the note arrangement and further support for ten (10)-note polyphony, during performances, with an option of facilitated finger-play.

Yet another object of the apparatus of the present invention is the facilitation of wireless MIDI capability without external devices, in addition to allowance for control of devices on a MIDI network, with easy facilitation of synthesis of a wide variety of voices.

It is also another object of the apparatus of the present invention, to support a minimum of thirty-six (36) notes, i.e. three (3) full octaves, with the flexibility of extending to four (4) octaves, with simultaneous synthesis of multiple voices, which allows for arbitrary voice assignments to individual notes, or to groups of notes.

Yet an additional object of the apparatus of the present invention, is the employment of a single user interface for all synthesized instruments and voices, thereby eliminating one major source of confusion in the traditional steelpan performance environment i.e. the plethora of note layouts and drum configurations on different ranges of the instrument.

It is a further object of the present invention to provide an apparatus in which the control & display console is ergonomically designed, for ease of access to the various control functions during performances.

Yet another object of the present invention is to provide an apparatus to which easy access is further facilitated, by the ability to locate the control & display console anywhere within the optimal reach of the player.

Yet a further object of the present invention is to provide preset touch pads of similar construct to said muzi-pads, which facilitate selection of pre-programmed functions by striking said touch pads with a playing stick, thus allowing for rapid access to pre-programmed functions during a performance.

Still another object of the present invention is to provide control pedals which can be assigned by the user to perform any one of several functions. Said functions include a sustain effect in which the depressed pedal causes the current note to be held indefinitely, a damp pedal in which the depressed pedal causes the note to be immediately damped, a preset function that facilitates user defined reconfiguration of the instrument when the pedal is depressed, and a volume control.

Moreover, a further object of the apparatus of the present invention is the provision of a mounting stand, which is used to support the Main Assembly and control & display console, at a height and disposition which facilitates easy performance, said mounting stand being an optional component which may vary in form, shape, or size.

Yet another object of the present invention recognizes that in some in-situ applications, a player may wish to omit the stand altogether, so as to have the optional flexibility of carrying the apparatus of the present invention while performing and so the main assembly and control & display console are light enough to facilitate this mode of performance and can, for example, be suspended by a strap from the player's neck with minimum or possibly no discomfort being experienced.

Finally, it is an additional object of the apparatus of the present invention, to further facilitate portability, as said present invention is equipped with a rechargeable battery device, which is automatically topped up when said invention is docked onto the mounting stand.

These and various other advantages and features of novelty which characterize the apparatus of the present invention are provided throughout this disclosure. However, for one skilled in the art to have a better understanding of the invention, its advantages and the objects obtained by its use, reference should be made to the drawings which form a further part hereof, to the accompanying description and to the claims.

BRIEF DESCRIPTION OF THE DRAWINGS

FIG. 3 provides top, frontal and side projections of the main assembly of said apparatus of the present invention.

FIG. 4 provides top and side cutaway sections as well as an isometric projection of said apparatus of the present invention.

FIG. 7 provides top, frontal and bottom perspective views of a preferred embodiment of the muzi-pad of the apparatus of the present invention.

DESCRIPTION OF THE PREFERRED EMBODIMENT

In a preferred embodiment, the apparatus of the present invention comprises novel, state-of-the-art, electronic musical apparatus, while being imbued collectively with desirable characteristics from existing percussive instruments, including the now generic conventional acoustic steelpan and in this process, catalyses the evolution of the aforementioned acoustic instrument to another level.

The apparatus of the present invention is a distinctly innovative, electronic musical concept, which borrows characteristics from existing percussive instruments including the conventional acoustic steelpan. In particular, the appearance of the instrument is quite similar to that of the traditional tenor steelpan, having the same general concave hemispherical shape upon which note bearing surfaces, a minimum of 36 or three octaves, are placed. The instrument is played in percussive mode as musical sound is generated by striking said note bearing surfaces, called muzi-pads, that are designed to emulate the note generation characteristics of the traditional steelpan in which timbre varies depending on where notes are struck. Sound is produced by internal or external synthesizers utilizing the MIDI protocol on standard MIDI, Ethernet, Firewire or USB physical layers.

The apparatus of the present invention utilizes state-of-the-art electronics to provide extensive controls that facilitate reconfiguration of instrument characteristics, note layout, being the arrangement of notes assigned to muzi-pads and voice emulation. The electronics is also used to empower a "tutor mode" in which a MIDI stream from an internal or external source is used to turn on light elements placed on or near the muzi-pads to indicate the next note or combination of notes to be played.

Figure 1:
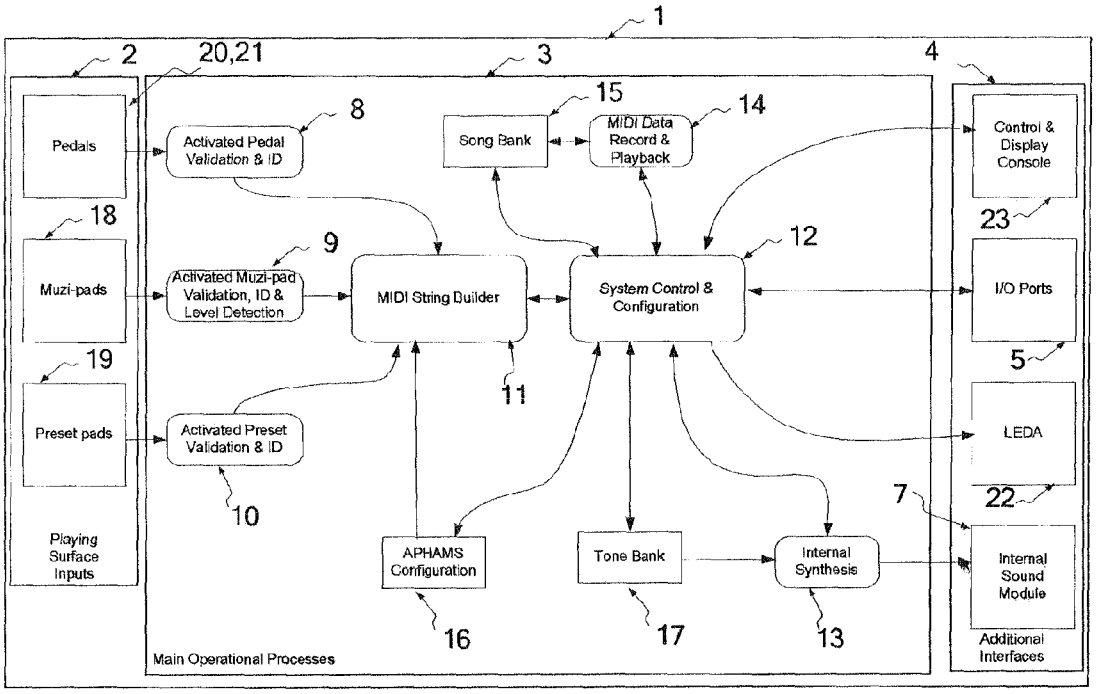
FIG. 1 is a top level conceptual schema displaying the functional components of the present invention.

Reference is now drawn to FIG. 1 which shows a top level schema of the apparatus of the present invention.

The top level schema 1 of FIG. 1 is a conceptual model of the apparatus of the present invention that provides a template for a workable design of the apparatus of the present invention. As a top level schema, it does not make specific reference to hardware or software subsystem realizations but is confined to conceptual processes that are required for the functionality of the present invention.

The schema uses the Gane-Sarson convention whereby data transforming processes are represented by oblong shapes, data storage areas are represented by open sided rectangles and input and output interfaces by closed rectangles. Data movement is indicated by arrows.

The schema 1 is divided into three main sections: playing surface inputs section 2 which includes all interfaces used by the player to generate and modulate the musical notes required for a performance and are by far the most visible user interface objects on the present invention, additional interfaces section 4 that incorporates all other interfaces required for further interaction with the user, as well as the external environment and, finally, the main operational processes section 3, that links the playing surface inputs section 2 to the additional interfaces section 4 and therefore incorporates all of the processes required to transform inputted data to produce all required outputs.

It should be noted that different embodiments of the apparatus of the present invention can realize the main operational processes 3 of this schema completely in hardware, completely in software, or in any combination of the two. In this regard, the same reference numbers are replicated in other Figures in the document that refer to hardware or software perspectives of the same entity.

The inputs encapsulated in the playing surface inputs section 2 include the muzi-pads 18 which are struck by the player to produce the musical notes that comprise the performance piece, the preset pads 19 that can be set up to rapidly select pre-programmed configurations of the instrument and the foot pedals 20, 21, that facilitate modulation of any note that is currently being played.

In addition, the present invention inputs user selected configuration data and commands from the control & display console 23 as well as from a variety of sources that are summarily referenced in FIG. 1 as the I/O ports interface 5 in the Additional Interfaces section 4.

The I/O ports interface 5 facilitate MIDI input, configuration data and commands from remote sources. These remote sources include wired or wireless MIDI networked equipment such as MIDI controllers and wired or wireless commercial computer networks. MIDI and wireless MIDI ports are included in all implementations.

In the apparatus of the present invention each muzi-pad 18, has a light emitting device affixed in close proximity to or directly upon said muzi-pads 18, with one light emitting device per given muzi-pad 18. The collection of light emitting devices is summarily referred to in what follows, as a LEDA 22 being an abbreviation for Light Emitting Device Array. For ease of reference in all Figures the LEDA 22 and the light emitting devices will bear the same reference character in what follows.

The LEDA 22 is used to provide an indication of notes in a user selected MIDI command stream, which originates either directly from the muzi-pads 18, from an external MIDI source, or from a MIDI song file stored on the present invention. The LEDA 22 therefore facilitates music education using the apparatus of the present invention.

System interface outputs of the present invention are also summarily referenced in FIG. 1 as the I/O ports interface 5 and include the control & display console 23 for display of system status and configuration data, the LEDA 22 and the internal sound module 7. External system outputs of the present invention are directed through the I/O port interface 5, for connection to remote sources such as wired or wireless MIDI networked equipment such as MIDI sound modules and wired or wireless commercial computer networks.

A variety of I/O Port standards are supported. All instruments of the present invention feature DIN standard MIDI ports to support the standard MIDI serial transmission protocol. However, the preferred embodiment also includes USB and Ethernet ports for MIDI as well as general purpose interface requirements.

In the primary functional mode, data originates from the playing surface inputs section 2 and are transmitted to the main operational processes section 3 where it is packaged to conform to General MIDI specifications. This information is then transmitted to at least one of the I/O Ports 5, the LEDA 22 or internal sound module 7 components of the additional interfaces section 4 for output.

Inputs from the muzi-pads 18 are directed to the Activated Muzi-pad Validation, ID and Level Detection process 9. This is a dedicated process that detects, identifies and validates the current muzi-pad that has been struck by the user. Muzi-pad 2 identification 425 is by way of a unique assigned ID number as shown in Table 1, for example. Validation, which includes threshold detection and debouncing, ensures that the system is not forced to respond to spurious and erroneous inputs. Level detection is provided to reflect the intensity with which said muzi-pad 18 has been struck through force or velocity sensing.

Inputs from the pedals 20, 21 and preset touch pads 19 are respectively directed to the Activated Pedal Validation and Ill process 8 and Activated Preset Validation and ID process 10. These are dedicated processes that detect, identify and validate the actual pedal or preset input that has been activated by the user. Pedal and preset input identification is by way of a unique ID number assigned to a pedal or preset. Validation, which includes, inter alia, threshold detection and debouncing, ensures that the system is not forced to respond to spurious and erroneous inputs.

The outputs of the Activated Pedal Validation and ID process 8, the Activated Preset Validation and ID process 10 and the Activated Muzi-pad Validation, ID and Level Detection process 9 are transmitted to the MIDI String Builder process 11. This process is responsible for packaging the data received into a data stream that conforms to the General MIDI protocol reflecting the value and attributes of the note that has been struck.

The MIDI data stream is then transmitted to the System Control and Configuration Process 12 that routes the stream to the output ports in the I/O Ports module 5 or to the Internal Synthesis process 13 or to the Record and Playback process 14. The user can configure the System Control and Configuration process 12 to route the data stream to any or all of the paths identified.

The Internal Synthesis process 13 provides an interface between the System Control and Configuration process 12 and the internal sound module 7. In this regard it is also used to manage and access sampled sounds in the tone bank 17.

The MIDI Data Record & Playback process 14 facilitates the capture, storage and replay of MIDI sequences generated by the player. In this regard, the MIDI Data Record & Playback process 14 accesses songs in the Song Bank 15 and includes a metronome to facilitate performance timing. In addition, the present invention allows the player to download MIDI files through the I/O Ports interface 5 for storage in the Song Bank 15.

The Song Bank 15 and Tone Bank 17 are partitioned into internal fixed memory and external removable memory; the latter can be implemented in any of the standard formats, including Secure Digital, Smart Media or USB Memory Keys. Computer software, packaged with the present invention, allows the player to store MIDI files as well as Tone Bank 17 sound files, from a computer on the removable memory device.

The System Control and Configuration Process 12 is also used to set up other configuration parameters for the present invention, through user interaction with the Control and Display Console 23 or from remote sources, including computer networks, via the I/O Ports interface 5. The System Control and Configuration Process 12 stores these parameters in the Configuration storage memory 16 of the present invention.

Configuration parameters include, inter alia, music performance parameters such as the physical layout of notes on the playing surface 25, muzi-pad 18 note assignment, note voice, APHAMS MIDI address, external device MIDI channel and patch numbers, I/O port selection, Internal Synthesis 13 activation, MIDI Data Record & Playback process 14 activation, selection of the current song in the Song Bank 15, selection of tone in the internal synthesis Tone Bank 17 and Control and Display Console 23 features.

The MIDI output command stream generated by the MIDI String Builder 11 in response to a strike on a single muzi-pad 18, would typically consist of the MIDI Note On command, immediately followed by a MIDI Note Off command. The MIDI Note Velocity data that is to be included in the MIDI Note On command, is determined by one of a plethora of methods. The preferred method uses the muzi-pad 18 trigger level, measured as a pointer to a look-up table of velocities.

The software that implements much of the structure of FIG. 1, also enables a vast range of capabilities in the creation of sound, by providing a range of algorithms used by the MIDI String Builder 11.

For example, to implement the aftertouch feature described in the standard MIDI protocol, MIDI command streams would consist of the MIDI Note On command, which would then be followed by a MIDI Aftertouch command, that would be repeated at regular intervals, typically every 100 ms until the mallet or stick pressure on the muzi-pad 18 is removed. Subsequently a MIDI Note Off command would be sent. MIDI Aftertouch commands continuously communicate the note and note velocity while the note is playing. This capability therefore enhances the musical performance by allowing the player to modify the intensity of a note by varying the pressure of the stick on the muzi-pad 18 during a strike.

In addition, the apparatus of the present invention readily implements, through the software that enables much of the structure of FIG. 1, a single stick chord feature whereby selected muzi-pads 18, trigger the generation of selected chords being comprised of multiple notes in the same voice or a multi-voice capability, whereby selected muzi-pads 18, trigger the generation of multiple voices in the same note.

The design of the muzi-pads 18 facilitates the generation of subtle variations of tone, whereby the second and third harmonic can be enhanced, by striking different sections of the relevant muzi-pad 18. This design facilitates the emulation of a similar characteristic on a traditional steelpan instrument that is harmonically tuned, whereby the player can emphasize the second or third partials by striking the edges of the note areas. It requires that each muzi-pad 18 be equipped with three individual sensors that are used to trigger, through the MIDI String Builder 11, three separate MIDI commands, corresponding to the respective note and its first and second harmonic, with each strike of the muzi-pad 18. More details of this design are described below.

The preferred embodiment of the design described must satisfy one key performance objective. It must have the lowest possible performance latency this being defined as the maximum delay in the primary function of the start of generation of an output MIDI stream at the selected I/O Ports in response to a trigger generated by the striking of a muzi-pad 18. This ensures that the apparatus of the current invention does not significantly contribute to the degradation in real time performance, by adding to the delays that exist in the internal sound module 7 and any external devices to which the present invention is connected.

The preferred embodiment of the apparatus of the present invention as described, obtains the lowest possible latency while achieving maximum design flexibility and user features, by partitioning the processes identified in FIG. 1 into sections that are to be implemented in hardware, or in software and interconnecting the two with interrupt driven processes.

Specifically, as they provide the interface to the player in regard to the primary performance function which requires real time detection, validation and measurement of the striking action on the muzi-pads 18, the Activated Preset Validation & ID process 10, the Activated Muzi-pad Validation, ID & Level Detection process 9 and the Activated Pedal Validation & ID process 8 are all largely implemented in analog and digital hardware. All other processes required for the generation of MIDI data streams are implemented in software.

Typically, then, when the player strikes a muzi-pad 18, the aforementioned hardware components identify the muzi-pad 18, validate the signal to eradicate the possibility of error due to spurious inputs and measure the intensity of the strike. The software components are then alerted to the occurrence of the strike event by use of the interrupt facilities on the processing device used to implement said software. These software components subsequently input data from the hardware modules so as to identify the struck pad as well as the intensity of strike. Apart from the implicit and required timing functions of the processing device used in the apparatus of the present invention, muzi-pad 18 and preset pad 19 interrupts, are placed at the highest priority thus ensuring the fastest possible response to a strike event.

The computing power required to implement all software processes can be realized from an embedded processor, an array of such processors either as separate hardware or part of an FPGA or ASIC core. Digital hardware components can be realized on an FPGA or ASIC core as well.

Prototypes that have been constructed using the XILINX Spartan 3 FPGA and the PIC18F6520 embedded processor have attained latencies of less than 500 μs. According to the Complete MIDI 1.0 Specifications published by the MIDI Manufacturers Association, MIDI systems can achieve an overall MIDI latency of 3 ms or less. It is known at random, that typical commercial MIDI controller and synthesis devices have latencies of no more than about 5 ms and, as such, when used with said commercial devices, the overall latency of the apparatus of the present invention, being the delay between striking a pad and actually hearing the corresponding sound, would be no more than 5.5 ms, substantially less than the 10 ms maximum limit recommended by the Complete MIDI 1.0 Specification.

Reference is now made to FIGS. 2, 3, 4 and 5 which provide illustrations of the physical form of the preferred embodiment of the present invention.

Figure 2:
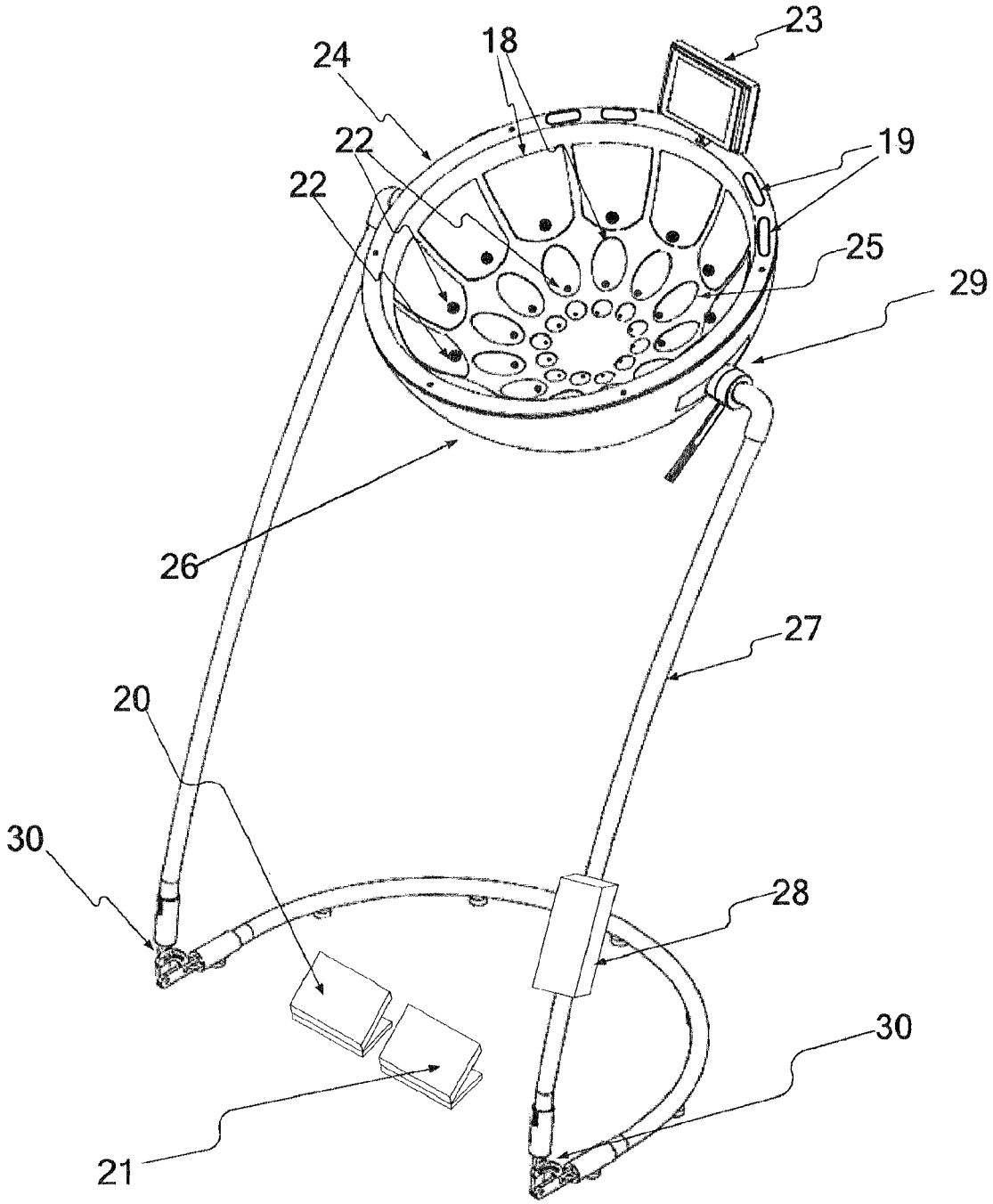
FIG. 2 is an isometric view of a preferred configuration of the apparatus of the present invention.

In particular reference now to FIG. 2, a top level schema, a preferred embodiment of the apparatus of the present invention comprises three main physical components, namely:

(a) the main assembly 24;

(b) the control & display console 23 and;

(c) the mounting stand 27.

The main assembly 24 of said apparatus, consists of a playing surface 25, mounted upon a chassis, the main assembly chassis 26. The playing surface 25 is comprised of an array of muzi-pads 18 physically arranged in concentric rings, with twelve muzi-pads 18 per ring and three (3) or four (4) rings per array.

Each muzi-pad 18 has a light emitting device 22 affixed as shown in FIG. 2 in close proximity to or directly upon the muzi-pads 18, with one light emitting device 22 per muzi-pad 18. Said light emitting devices therefore make up the LEDA 22.

The main assembly 24 is also used to house electronic circuitry that takes input from the muzi-pad 18 array, foot pedals 20, 21, external inputs as well as the control & display console 23 and uses these inputs to output the MIDI out signals, control signals for the LEDA 22 and control & display console 23 display signals. The main assembly 24 also houses a rechargeable battery that facilitates complete portability of the present invention.

Again in reference to FIG. 2, the BEGIN pedals of the present invention, includes foot pedals 20, 21 that can be used to modulate the generated sound. Commercially available pedals that utilize potentiometers or any other technology that provides continuously variable electrical voltage output of pedal position, can be used thus facilitating their application as a volume control or as a pitch bend wheel. Said foot pedals can also be employed as switches by establishing a threshold voltage that indicates when the pedal is pushed past a predetermined point. For the preferred embodiment the threshold level will correspond to a point that is half-way of the travel of the pedal.

Through options provided in the software that operates the apparatus of the present invention any of the foot pedals 20, 21 can be configured by the user to generate a variety of effects. When the configured pedal is depressed the apparatus of the present invention can generate any one of a sustain effect, whereby the current note is held indefinitely, a damp effect, whereby the current note is immediately damped, a switch for synchronizing the start and end of a stored rhythm sequence or a user definable preset switch. In addition, the foot pedals can be used for volume control or a pitch bend control.

The sustain effect is implemented by sending the MIDI Hold Pedal command between MIDI Note On and MIDI Note Off commands once said pedal is depressed. The damp effect is implemented by immediately sending a MIDI Note Off when said pedal is depressed. Similarly, the volume effect is implemented by sending the MIDI Volume command followed by a data byte value, that is determined by the pedal position and pitch bend control is implemented by use of the MIDI Pitch Wheel command, followed by data bytes indicating the level of pitch deviation as determined by pedal position of END pedals.

The BEGIN playing surface 25 is typically a concave semi-spherical shape. Other playing surface 25 shapes are possible mutatis mutandis, but the preferred concave shape, as pertains for the traditional instrument, as its surface is within the envelope defined by the maximum reach of the average height human thus allowing for easy reach to all muzi-pads 18. Said surface is therefore desirable for its ergonomic characteristic which facilitates smooth performance in a musical environment, in which performers are prone to repeated stress injuries.

The preferred embodiment uses a playing surface 25 with a maximum depth in the range 7.5 inches/19.1 centimeters to 10 inches/25.4 centimeters and a width from 18 inches/45.72 centimeters to 26 inches/66.04 centimeters. These dimensions facilitate comfortable access to all muzi-pads in the usual performance mode in which the apparatus is positioned in front of the player for all but the shortest or tallest players. The playing surface 25 can be constructed from a variety of materials including wood, plastics, fiberglass, composites and metal and could be augmented with structural support mechanisms consisting of ribs and battens to increase strength and rigidity.

Muzi-pad recesses 33 facilitate the placement of said muzi-pads 18 in such a manner that said muzi-pad 18 surface seamlessly merges into the playing surface 25, thereby providing a smooth appearance of said surface. This not only provides for excellent emulation of the surface of the traditional steelpan but also facilitates performance by minimizing the risk of the player being impeded as would be the case if said muzi-pads 18 were not smoothly merged into the END playing surface 25.

Figure 5:
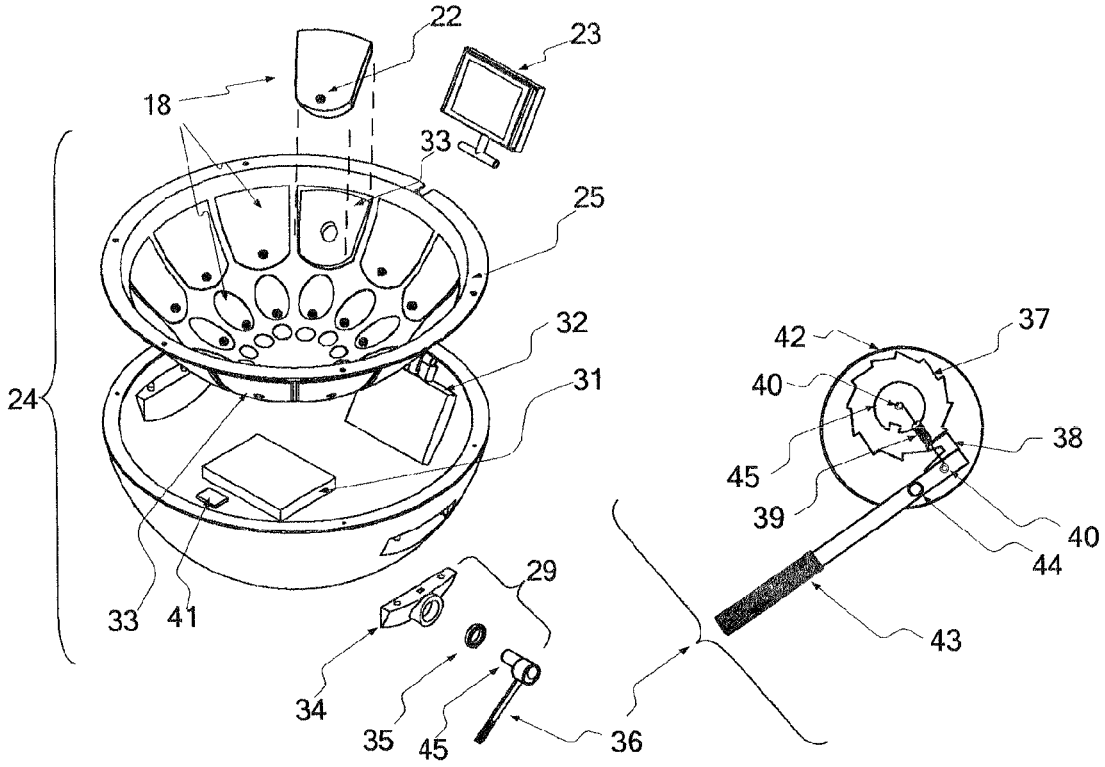
FIG. 5 is an exploded view of the main assembly with control & display console.

In reference to FIGS. 2 and 5, the playing surface 25 also features preset touch pads 19 which, when activated, triggers the operating software to configure the present invention with a set of features as pre-selected and assigned to said preset pad 19 by the player.

The preferred embodiment caters for four preset touch pads 19. The physical pads shown in FIG. 1 can be activated by touch, or by striking with the same mallet used to play the present invention and are of are of similar construction and operation to the muzi-pads 18. However, as they are used purely as switches, force and velocity sensing of preset pad 19 input is not required as for the muzi-pads 18.

The preferred embodiment of the invention also provides virtual preset pads which are special areas displayed on the control & display console 23 touch screen and which, when activated, triggers the operating software to configure the present invention, with a set of features as pre-selected and assigned to said virtual preset pad by the player.

The operating software also enables any preset pad, physical or virtual, to be programmed by the player by manually configuring the desired setup of the present invention and subsequently selecting a "save configuration to preset" option in the user customization menu displayed on the control & display console 23.

Furthermore, by using preset groups, the operating software of the present invention allows for saving of a greater number of configuration settings, than there are physical or virtual preset pads. Each preset group is a unique, separate and complete collection of assigned settings of all physical preset pads 19 and virtual preset pads. With this feature, any single physical preset pad 19 or virtual preset pad, can be used to access as many configuration settings as there are groups instead of just one configuration setting as before.

With the preset groups, selection of pre-programmed settings would now proceed, by first selecting the relevant preset group and subsequent activation of the required physical preset pad 19 by striking the desired preset pad 19 with the playing stick, or tapping them with the finger or of the required virtual preset pad, by touching the portion of the touch screen assigned to this purpose.

The preferred embodiment of the present invention provides a total of at least twelve preset pads, comprising four physical preset pads 19 and at least eight virtual preset pads, all arranged in at least two groups, thus allowing for rapid access to a total of at least twenty four pre-programmed configurations of the present invention during a performance, as each of the twelve presets can now access one of two pre-configured settings.

In reference to FIG. 2 and FIG. 5, the light emitting devices 22 may consist of neon bulbs, incandescent bulbs, Light Emitting Diodes (LED) or other light emitting devices or a combination of these technologies. LEDs are the preferred mode of implementation due to their low cost and higher power efficiency.

In the preferred embodiment, the LEDA 22 can be activated or de-activated by user configuration of the operating software of the present invention. When de-activated all light emitting devices in the LEDA 22 are switched off. When activated, the LEDA 22 operates in either a diagnostic mode or a tutor mode, as selected by the user.

In the diagnostic mode, each light emitting device 22 flashes once for each impact on the muzi-pad 18 with which it is associated. In the tutor mode the light emitting devices in the LEDA 22, light to indicate which muzi-pads 18 are to be struck in response to a MIDI stream, that is either an input from an external device, via the MIDI network to which the present invention is connected, or from internal memory storage.

The inclusion of the LEDA 22 as described facilitates music training in a variety of ways. The apparatus of the present invention or an external MIDI device, could be configured to send one MIDI track, for example the lead or melody track of a recorded performance, to the LEDA 22 while the background tracks are played on a given sound system. This allows a learner to play music on the apparatus of the present invention using MIDI generated accompaniment. The most rigorous learning environment would involve the use of preferred training software running on a MIDI enabled computer, to facilitate the range of END LEDA drills and exercises required.

The BEGIN Control Console as shown in FIGS. 1 to 4 of the present invention features a control & display console 23 that accepts inputs for user configuration of the instrument and equipment on any MIDI network to which the present invention is connected and provides for a wide range of user-friendly functions including pad customization, voice selection, keypad mapping, transposition, simultaneous synthesis of multiple voices, MIDI channel, MIDI bank, note number, note octave number and tempo information. Inputs can take the form of physical tactile sensors, buttons or switches, or virtual buttons or switches, as displayed on a touch screen.

The control & display console 23 also provides a visual display of menu options and status and configuration settings of the present invention.

In addition, the apparatus of the present invention allows for distributed implementation of said control & display console 23, whereby different aspects of the functionality of said control & display console 23, can be distributed around the playing surface 25 to facilitate easy access. For example, physical buttons and switches can be placed in and around the playing surface 25, while a display screen can he retained in the position as shown in FIGS. 1 to 3. In the preferred embodiment, said control & display console 23 integrates all required functions into a single a touch-sensitive display module as shown in FIGS. 1 to 3. The physical shape of the control console is not limited to that illustrated in the Figures.

In addition, in the preferred embodiment of the apparatus of the present invention the control & display console 23 can be folded and retracted into a recess, the control & display console recess 32, located at the rear of the main assembly 24.

Said control & display console 23 menu navigation features, allows the user to navigate though the menu displayed on the electronic visual display to select the required options of the END Control and Display Console.

On the BEGIN Mounted Stand, being its expected normal application, the present invention will be played with the user in a standing position. To this end, the dimensions shown in FIG. 2 factor in ergonomic considerations for user height, reach and access to the control features of the present invention, such as the muzi-pads 18 and control & display console 23.

In addition, the height of the playing surface 25 mounted on the main assembly 24 can be adjusted by using minimum effort to rotate same on the mounting stand locking hinge 30.

Moreover, at any given height adjustment, the attitude of the main assembly 24 can be adjusted using the rocker arm/attitude lock assembly 29 details of which are shown in FIG. 4. Said rocker arm/attitude lock assembly 29, comprises a rocker arm support 34 that is used to attach the attitude lock 36 to the main assembly 24 through the rocker arm 45 housed in the rocker arm/attitude lock assembly 29. The rocker arm 45 is mounted on a rocker arm bearing 35 attached to the attitude lock body 42, thus facilitating free rotation of the main assembly 24, once the rocker arm/attitude lock assembly 29 is in an unlocked position.

The attitude lock 36 is comprised of a ratchet 37 and pawl 38 which is held in a locking position by a spring 39. Bracing pins 40 are used to attach the spring 39 to the centre of rotation of the rocker arm 41 and the attitude lock handle 43. Said handle is hinged on the attitude lock handle pivot 44 and is used to lock and release the pawl 38 from the ratchet 37. The entire rocker arm/attitude lock assembly 29 is prevented from rotating by firmly attaching the attitude lock body 42 to the mounting stand 27.

Pulling said handle upward disengages said pawl 38 from said ratchet 37 allowing free rotation of the main assembly 24 which is firmly attached to the rocker arm 41. The attitude of said main assembly 24 is then locked in the selected position by simply releasing the attitude handle lock 43. This allows the spring 39 to pull the pawl 38 back into its locking position against the ratchet 37. This design minimizes the risk of a user accidentally releasing the lock mechanism during a performance as the mechanism described can only be unlocked by forceful upward motion of the attitude lock handle 43.

A counterweight 41 placed on the main assembly chassis 26 at a point that is closest to the player to ensure that the main assembly rotates by default towards the player when the rocker arm/attitude lock assembly 29 is released. In addition to the spring 39 this further ensures that said ratchet 37 and pawl 38 are fully engaged when the mechanism is in the locked position, thus essentially eradicating the possibility of accidental rotation of the main assembly 24 towards the player.

Furthermore, although the main assembly 24 can be rotated away from the player by simply pushing the part of said main assembly 24 that is furthest from the player, the counterweight 41 reduces the risk of said rotation occurring accidentally by ensuring that the force required is more than would be experienced when muzi-pads 18 located furthest away from the player, are struck during a normal performance.

The curved design of the mounting stand 27 provides a degree of aesthetics while facilitating necessary movement of the present invention during vigorous performance. This emulates the playing environment of the traditional steelpan where the natural movement of the instrument, which is usually freely suspended, enhances the dynamic appeal of any performance.

Apart from its role in physically supporting the main assembly 24 and the control & display console 23 in the present invention, the mounting stand 27 provides the function of a docking station to provide mains driven power, MIDI and general network connectivity to the said invention through a detachable connector pod 28. The power supplied through the connector pod 28 is also used to recharge a battery in the main assembly of the instrument.

The present invention can be used without the mounting stand 5 by detaching the connector pod 28 and main assembly 24. This allows the palmist to utilize the present invention on other user-supplied stands and supports and also to perform in a fully portable mode while in motion by supporting the apparatus of the present invention from the neck using a strap, as occurs with the traditional steelpan, or from the torso using a suitably designed brace. In the latter case, MIDI signals are transmitted to a MIDI sound module and sound system by way of an integrated wireless MIDI END Mounting Stand.

Muzi-pads 2 are specially designed surfaces that include a trigger mechanism, namely the BEGIN Muzipads, for the generation of a desired note. The trigger mechanisms are electronic sensors that generate a signal when the muzi-pad 18 is played with an appropriately sized mallet, stick, or other such similar playing implement. The muzi-pad sensors 59 will also detect impacts from the hands and fingers. Details of the muzi-pad 18 design and layout are illustrated in FIGS. 6 and 7.

Figure 6:
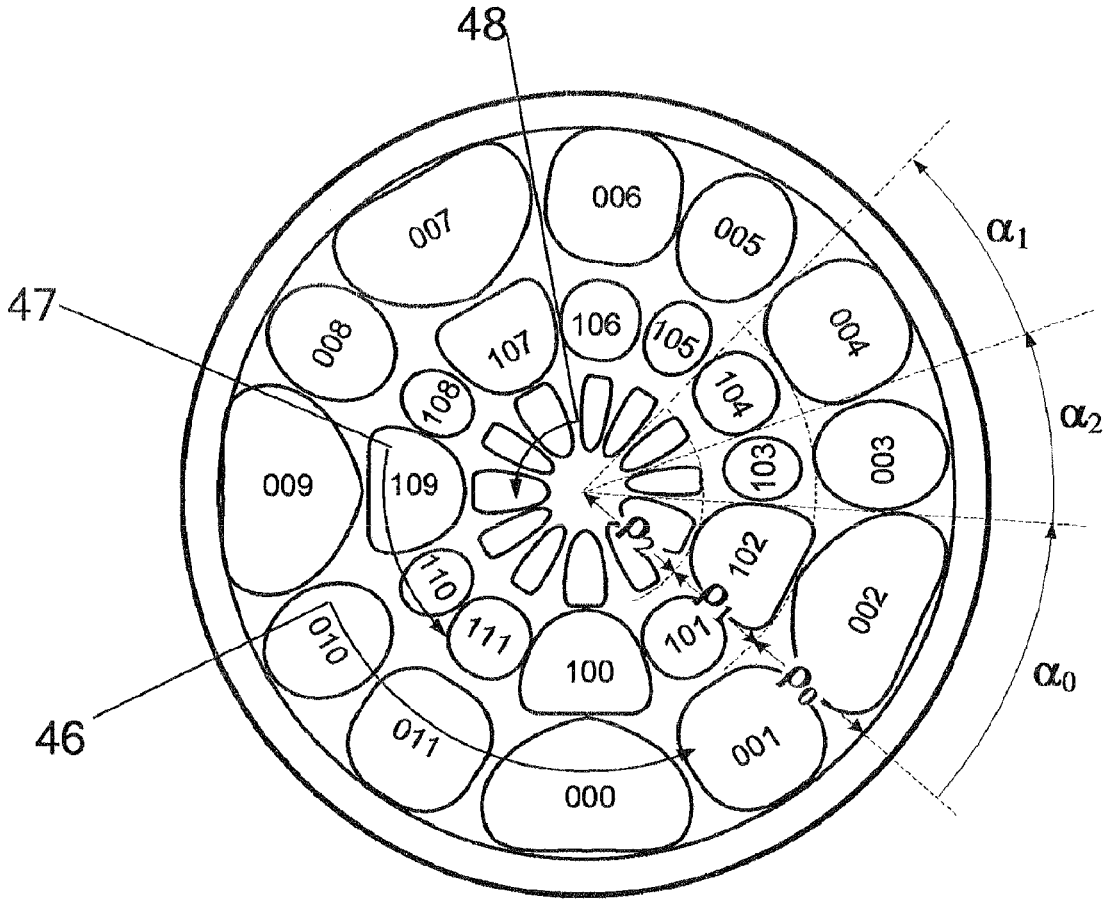
FIG. 6 displays a preferred embodiment of the note configuration on the playing surface of the apparatus of the present invention.

For convenience, and for clarity of communication, muzi-pad 18 rings are laid out and numbered as shown in FIG. 6 from 0 to $N_R-1$, where $N_R$ is the number of rings. In the preferred embodiment, $N_R=3$ with the outermost ring being designated as Ring#0 46, the inner ring as Ring#1 47, and the innermost ring as Ring#2 48.

In addition, muzi-pads 18 carry an identifier of the form Rxx, where R is the ring number and xx is a two-digit number code that is a decimal integer in the range zero (00) to eleven (11). In the preferred embodiment of the present invention the numbers in the number code increase sequentially in a counter clockwise direction; however, it is possible for the sequence to be reversed so that the code numbers increase in the counterclockwise direction. The identifier numbers are therefore 000 to 011 on Ring#0 46, 100 to 111 on Ring#1 47 and 200 to 211 on Ring#2 48.

Table 1 which is shown below lists two note layouts for the muzi-pads 18 corresponding to the cycle of musical 4ths and 5ths note layout and the chromatic note layout respectively. The default layout follows the cycle of musical 4ths and 5ths. In any of these layouts each ring is assigned to a musical octave that is selected by the user. The preferred embodiment of the present invention provides octave ranges as designated by its standard octave number in scientific pitch notation, i.e. from Octave 0, Cy to $B_0$, to Octave 7, $C_7$ to $B_7$. The C-note is automatically set as the lowest note in the selected 830 octave range and therefore assigned to the R00 muzi-pad 18 of the respective ring.

Note assignments are stored in RAM in a note allocation table that can be accessed by the user through user interface options presented on the control & display console 23 thus allowing the player the ability to change the note layout to any arbitrary configuration.

TABLE 1

| Pad | Ring #0 | 000 | 001 | 002 | 003 | 004 | 005 | 006 | 007 | 008 | 009 | 010 | 011 |
|---|---|---|---|---|---|---|---|---|---|---|---|---|---|
| Number | Ring #1 | 100 | 101 | 102 | 103 | 104 | 105 | 106 | 107 | 108 | 109 | 110 | 111 |
| | Ring #2 | 200 | 201 | 202 | 203 | 204 | 205 | 206 | 207 | 208 | 209 | 210 | 211 |
| Assigned | 4th and 5ths | C | G | D | A | E | B | $F^{\#}$ | $C^{\#}$ | $A^b$ | $E^b$ | $B^b$ | F |
| Notes | Chromatic | C | $C^{\#}$ | D | $E^b$ | E | F | $F^{\#}$ | G | $A^b$ | A | $B^b$ | B |

FIG. 7 provides perspective views of a preferred embodiment of said muzi-pad 18 of the apparatus of the present invention. It should be noted that a wide variety of muzi-pad 18 shapes and contours are possible. FIG. 7*a* provides a top view 49, of one preferred embodiment of the muzi-pad 18 that has a curved surface contour surface. FIG. 7*b* and FIG. 7*c* provide respectively an exploded front view 50 and a bottom view 51 of said preferred embodiment.

Said muzi-pads 18 are comprised of electronic sensors 59, called muzi-pad sensors 59, attached to a contoured shell, the muzi-pad shell 53, made from sheets, panels, plates, or thin blocks of metal, plastic, other solid synthetics, glass, wood, or any other such solid material. The muzi-pad shell 53 is covered on top by an impact filter pad 54 and is attached on the bottom to a frame, the muzi-pad frame 52.

Said muzi-pad shell 53 is thin enough and rigid enough, so as to allow enough of the energy imparted to it to be transmitted to the muzi-pad sensors 59, that generate the trigger signal to be used by the processing circuitry of the present invention, to be later described. A wide variety of muzi-pad shell 53 material and geometry and sensor technology exist that ensure proper and reliable triggering of said muzi-pad sensor 59. Prototype implementations using 0.63 cm/0.25 in PVC material for said muzi-pad shell 53 and ceramic Piezoelectric transducers for said muzi-pad sensors 59 have been quite successful.

The top surface of said muzi-pad 18 is covered with an impact filter pad 54 made of foam or rubber or other suitable compliant material. In the preferred embodiment the material would have a Shore A hardness in the range 70 to 90 and should be of thickness of no more than 0.63 cm/0.25 in. Said top surface would be the part of said muzi-pad 18 that is struck with a solid mallet to generate the musical sound.

The impact filter pad 54 made may be omitted as desired. When omitted, the tip of the playing stick or mallet should be covered with a suitable compliant material to minimize impact noise and surface damage to said muzi-pad 18. In the preferred embodiment said compliant material would have a Shore A hardness between 70 to 90. Although, not necessary, omission of the impact filter pads 54, renders the present invention more sensitive and is particularly useful if the player wishes to play the apparatus of the present invention with the hands or fingers.

In the preferred embodiment of the present invention said muzi-pad shell 53 is affixed to a frame, the muzi-pad frame 52. Said frame strengthens said muzi-pad 18 thus increasing its resistance to flexure from acoustic stimulation thus reducing the possibility of the sensors being inadvertently triggered in environments with extremely high sound pressure levels. The structure of said muzi-pad 18 and the materials used for its construction must be such that muzi-pads 18 are not triggered by external sounds when exposed to sound levels at the top rim of the apparatus of up to 120 dBSPL, the generally accepted maximum sound pressure level tolerable by the average human, and in the frequency range 15 Hertz to 15,000 Hertz, the typical range found in musical performances.

The muzi-pad frame 52 also increases muzi-pad 18 resistance to vibrations borne by the playing surface 25 structure. This reduces the possibility of crosstalk, whereby a muzi-pad 18 is inadvertently triggered when another is struck or when the playing surface 25 is inadvertently struck. Muzi-pad 18 resistance to playing surface 25 structural vibrations is further reduced by the use of vibration absorbing mounts 55 to attach said muzi-pad frame 52 within said muzi-pad recess 33.

FIG. 7*c* also shows said muzi-pad sensors 59 attached to the underside of said muzi-pad 18. Each muzi-pad 18 can carry one or more sensors. Said muzi-pad sensors 59 as used on the pads, can take a variety of forms that allow for the measurement of impact velocity and force. The type of sensors that could be used for this purpose includes, inter alia, piezo-electric, Hall, strain gage and resistive sensors.

Sensors with frequency responses down to 0 Hertz (DC) facilitate the note sustain effect when constant static pressure is maintained on the muzi-pad 18. These include sensors such as Hall effect sensors, strain gage sensors and flexible resistor sensors. Said sensors have the disadvantage of requiring DC power for their operation, and a consequent increase in power consumption and wiring. Piezo-electric sensors do not respond down to zero Hertz but have the advantage of being able to generate high output levels while not requiring DC power for their operation. They also have the advantage of being more responsive to fast transient effects and are therefore generally better suited to detect the impacts characteristic of percussive performance.

FIG. 7*c* also shows said muzi-pad interface electronic circuit board 60 which, in the preferred embodiment, is mounted on said muzi-pad frame 52. The function of said electronic circuit is to interface said muzi-pad sensors 59 to the rest of the electronics of the present invention, providing impedance buffering, filtering and amplification functions as necessary. The design and complexity of the optional muzi-pad 18 electronic circuit on said muzi-pad interface electronic circuit board 60, would vary depending on the type of sensor used. However, the design and fabrication of such interface circuits is well known to those skilled in the art of designing electronic systems.

For example, the preferred embodiment of the present invention utilizes Piezo-electric sensors with muzi-pad interface electronic circuits 60 each of which implements a Field Effect Transistor (FET) source follower circuit for impedance matching of the very high impedance of said sensor, typically as high as 100 Megohms or more, to the low impedance input of the processing circuitry of the present invention to be later described. The source follower design is well known to those skilled in the art of designing electronic systems and is therefore not an inventive step. However, for the sake of completeness, a sample circuit, shown in FIG. 7*d*, will now be described.

FIG. 7*d* provides shows an implementation of one part of muzi-pad interface electronic circuit 60 to which a muzi-pad sensor 59 is connected at inputs 60*a* and 60*b* to generate buffered outputs at terminals 60*f* and 60*g*. The circuit uses a single low leakage FET 60*c*, such as the 4117 JFET, in a source follower configuration. The gate resistor 60*d* biases the gate at ground potential while quiescent current flowing through source resistor 60*e* biases the source above ground, thus establishing the reverse gate-source bias required for linear operation. Voltage fluctuations at the input terminals 60*a* and 60*b* appear at the same level at the output terminals 60*f* and 60*g* thus giving a circuit gain of one. However, as the source resistor 60*e* has a value that is typically no more than a few kilohms, much smaller than the resistance of the gate resistor 60*d* which would typically be in the range 20 megohm to 100 megohm, the output impedance is much smaller than the typical values specified for Piezo-electric transducers. Said circuit is powered by a positive DC supply applied to terminal 60*h*.

Reference is now again made to FIG. 7*a* which shows the top view 49 of the preferred embodiment of said muzi-pad 18 as seen by the player.

Muzi-pads 18 incorporate an array of strike zones to create a more realistic effect whereby the timbre of the note produced by said muzi-pad 18 is varied slightly when different parts of said muzi-pad 18 is struck. In the preferred embodiment of the present invention this variable timbre feature is implemented using three strike zones.

FIG. 7*a* shows the location of the strike zones 56, 57, 58 on a preferred embodiment of a muzi-pad 18. It should be noted that in the apparatus of the present invention, strike zones are not visibly obvious and that the areas in FIG. 7*a* are marked for discussion purposes only.

Sensors in the primary strike zone 56 are placed in the centre of said muzi-pad 18. The remaining strike zones are called secondary strike zones 57, 58 that consist of circumferential strike zones 57 and radial strike zones 58. Sensors on the circumferential strike zones 57 are placed along the extremities of said muzi-pad 18, that are closest to the concentric circles that bound the sector of the annulus in which said muzi-pad 18 is placed. Sensors on the radial strike zones 58 are placed along the extremities of the muzi-pad 18 that are closest to the radial lines that bound the sector of the annulus in which said muzi-pad 18 is placed.

The present invention implements the variable timbre feature by treating the primary strike zone 56, the circumferential strike zones 57 and the radial strike zones 58 as separate muzi-pads that are played in three-note polyphony when said muzi-pad 18 is struck. To emulate the variation of timbre experienced in most traditional steelpans, sensors in the primary strike zone 56 are used to trigger the note to which said muzi-pad 18 is assigned while sensors in the circumferential strike zone 57 are used to trigger the note one octave above that to which said muzi-pad 18 is assigned and sensors in the radial strike zone 58 are used to trigger the note that is one octave above the fifth above the note that to which said muzi-pad 18 is assigned. The fundamental frequency of said note that is one octave above the fifth above the note assigned to said muzi-pad 18 corresponds to the third harmonic of the note to which said muzi-pad 18 is assigned.

The variable timbre option influences the design of said muzi-pad interface electronic circuit 60. In particular, said muzi-pad interface electronic circuit 60 must now incorporate three separate sub-circuits as shown in FIG. 7*d*, one independent sub-circuit for each of the strike zones 56, 57, 58. The circuit shown in FIG. 7*d* would now realize one part of said muzi-pad interface electronic circuit 60 to which a muzi-pad sensor 59 or a parallel combination of muzi-pad sensors 59 in a single strike zone 56, 57, 58 is connected at inputs 60*a* and 60*b* to generate three independent buffered outputs corresponding to terminals 60*f* and 60*g*.

With the described configuration and implementation, the levels of each of the notes that are consequently triggered by sensors in the circumferential strike zone 57 and sensors in the radial strike zone 58 would vary depending on the actual location of strike on the relevant muzi-pad 18. It is, however, essential that sounds triggered by the primary sensor 27 always dominates that of the sensors in the secondary strike zones 28, 29.

A plethora of approaches exist for achieving the required dominance of the primary sensor 27, including the physical reduction in sensitivity of the sensors in the secondary strike zones 28, 29 by way of appropriate installation, or attenuation of the electronic signal generated by these sensors. In more advanced implementations, the location of the actual strike can be estimated from the outputs of the various sensors on said muzi-pad 18 and this information used to determine the relative levels of the polyphonic components triggered by said muzi-pad 18. Fuzzy logic algorithms can be used to facilitate implementation of this approach.

In the preferred embodiment of the apparatus of the present invention, dominance of the sound triggered by the primary sensor is obtained by implementing two user adjustable parameters in the operating software. The first is the secondary sensor attenuation factor (SSAF) that is a global variable that is applied to the trigger levels measured from sensors in the secondary strike zones 57, 58. The second is the maximum secondary sensor velocity (MSSV) that specifies the maximum MIDI note velocities of the octave and third harmonic notes triggered by the sensors in the secondary strike zones 57, 58 as a fraction of the MIDI note velocity of the note generated by the primary strike zone 56.

Said operating software in said apparatus of the present invention, measures the outputs of the two sets of sensors in the secondary strike zones 57, 58. If sensor output levels from these two zones are within ten to thirty percent of each other, stored variables corresponding to each of these sensor output values are zeroed thus effectively suppressing the variable timbre effect. Otherwise the stored variable corresponding to the sensor with the smaller output value is zeroed. This approach ensures that neither of the notes triggered by the two sets of sensors is played if the secondary sensors receive roughly the same amount of energy from the stick impact therefore localizing the variable timbre effect to the immediate vicinity of the secondary strike zones 57, 58. It also ensures that no more than one of the notes triggered by the two sets of sensors in the secondary strike zones 57, 58 is generated.

The secondary sensor output values are subsequently multiplied by the SSAF and the corresponding MIDI velocities determined. Contemporaneously the MIDI velocity of the note generated by the primary strike zone 56 sensor is determined. If the MIDI velocity of any of the notes triggered by the secondary strike zone 57, 58 sensors is greater than the MSSV multiplied by the velocity of the note triggered by the primary strike zone 56, they are automatically limited to a value obtained by multiplying the MSSV by the velocity of the primary strike zone 56 sensor.

The variable timbre feature is automatically disabled for all muzi-pads that are assigned to percussion instrument voices such as drums and cymbals, as well as for special effects.

Although the variable timbre feature targets more advanced users, it is also beneficial to all players as the tonal variations create a more natural environment by more closely emulating the feel of the traditional acoustic steelpan. The inclusion of various strike zones 56, 57, 58 also improves the natural character of a performance when voices other than the steelpan are selected.

Said muzi-pads 18 can be of arbitrary size, shape or color. However, for reasons described below, the preferred embodiment of the present invention assigns the physical attributes of size, shape and color to assist the player in the differentiating notes on the playing surface 25.

In this regard, it is to be noted that whereas the linear arrangement of notes on musical keyboards such as pianos allow for easy differentiation and identification of notes, such is not the case when notes are laid out in a concentric circular fashion as obtains with the current apparatus. The circular layout makes it difficult to quickly identify notes if the beginning or end of a particular ring cannot be quickly differentiated. In addition, as seen in FIG. 6, ring circumference reduces as one moves towards the centre of the playing surface 25, forcing the size of said muzi-pad 18 to be also reduced as one progresses from Ring#0 46 through Ring#1 47 to the inner ring, Ring#2 48.

All muzi-pads 18 used on the apparatus of the present invention may be of the same size; however, the preferred embodiment employs variations in the combination of shape, color and size of said muzi-pads 18, so as to provide visual cues to eliminate the confusion that arises when a pannist has to quickly identify the notes laid out in circular fashion.

As obtains on the traditional acoustic steelpan, variation in the surface area of said muzi-pads 18 in accordance with note pitch is used to provide a visual cue of the assigned note to the player. Thus said muzi-pads 18 associated with lower frequency notes are larger in size than those allocated to higher frequency notes. Due to the electronic character of the present invention, said muzi-pad 18 note sizes, need not be precisely calculated as is the case of the traditional steelpan. In addition, the number of size variations can be substantially reduced, thus reducing the cost of manufacture, by dividing an octave into an integral number of distinct chromatic clusters. For the purpose of this document, said clusters are defined to be groups of notes that form a contiguous subset of the chromatic scale. A single note size can then be assigned to each chromatic cluster.

The number of chromatic clusters required for effective application in regard to provision of visual cues for note identification depends on the actual note layout used. A chromatic note layout requires that said muzi-pads 18 assigned to chromatically adjacent notes should be also physically adjacent, except for said muzi_pads 18 with number codes zero (00) and eleven (11) at the start and end of each ring. As such a minimum of twelve different muzi pad 18 sizes are absolutely required for said chromatic layout. In practice, the maximum of thirty six different sizes will be required to implement all three octaves.

On the other hand, tests have shown that a layout using the cycle of musical 4ths and 5ths, the default on the current invention, can be effective with as few as three (3) muzi-pad 18 sizes, based on three (3) chromatic clusters of four (4) notes. The effectiveness of this approach is due to the fact that no two physically adjacent muzi_pads 18 will have the same size. In this regard, on any given ring, all muzi-pads 18 allocated to notes C, $C^{\#}$, D and $E^{b}$ would be allocated the largest size, muzi-pads 18 allocated to notes E, F, $F^{\#}$ and G would have a common smaller size, and muzi-pads 18 allocated to notes G#, A, $B^b$ and B would have a common smallest size.

The physical shape of said muzi-pads 18 can be varied to further augment the size variation strategy to assist in note identification. In this regard, successful application of the strategy would require that no two adjacent muzi-pads 18 in the same ring would have the same shape. As many as twelve (12) different shapes would then be utilized for this purpose. However, it is possible to achieve the same degree of note differentiation with a smaller number of distinct shapes, thus facilitating manufacture at lower cost. For example, two (2) different shapes can be alternated as one progresses around a given ring. Alternatively, as described for the strategy of size variation, a unique shape can be assigned to each chromatic cluster resulting in just three distinct shapes being used on each ring as shown in FIG. 6.

In addition, the size variation and shape variation strategies for note differentiation can be augmented by a varying color/shade scheme. The most logical color scheme would utilize increasingly lighter colors with increasingly higher note pitches, with one unique color/shade combination per note. This approach can be applied to all notes on the APHAMS, in which case a minimum of 36 color/shade combinations is required, or to a single ring with the color pattern being repeated on all rings in which case only twelve color/shade combinations would be required.

An alternative scheme would require that one unique color be allocated to all notes in any given chromatic cluster, instead of individual notes resulting in a minimum of three colors if the same color scheme is repeated on all rings and a maximum of nine distinct colors if distinct color schemes are applied to each of the three rings in the preferred embodiment.

The preferred embodiment of the present invention utilizes muzi_pad 18 physical attributes to provide visually, cues for note differentiation as follows and as shown in FIG. 6 and Table 2.

Notes are assigned to said muzi-pads 18 using the circle of musical 4ths and 5ths. Notes are grouped in three chromatic clusters, labeled CC0, CC1 and CC2 for convenience. In each ring, the four notes C, $C^{\#}$, D and $E^b$ are allocated to CC0, the next four notes E, F, $F^{\#}$ and G are allocated to CC1 and the last four notes in the octave G#, A, $B^b$ and B are allocated to CC2. These notes are assigned to muzi-pads 18 as detailed in Table 2. The same chromatic cluster labeling applies to all rings.

The same unique physical attributes of shape and color are applied to a given chromatic cluster, CC0, CC1 or CC2, regardless of actual ring location. In addition, all four muzi-pads 18 associated with notes in any given chromatic cluster have the same unique physical attributes of shape, size and color associated with that chromatic cluster. However, on any given ring, each chromatic cluster has its unique and distinct size attribute with size monotonically decreasing from CC0 through CC1 to CC2. In addition, for any given chromatic cluster, size decreases monotonically from Ring#0 46 to Ring#2 48.

Specific reference is again made to FIG. 6.

In the preferred embodiment, said muzi-pads 18 are sized by assigning them to a unique sector of an annulus with size as determined using the following formulae:

$$\alpha_0+\alpha_1+\alpha_2=90°$$

and $$\rho_0+\rho_1+\rho_2=D/2$$

where $\rho_0$, $\rho_1$, and $\rho_2$ are the respective radial lengths that define the radial length of the annuli occupied by muzi-pads 18 in Ring#0 46, Ring#1 47 and Ring#2 48, $\alpha_0$ is the central angle subtended by the section of annulus occupied by muzi-pads 18 assigned to notes in CC0, $\alpha_1$ is the central angle subtended by muzi-pads 18 assigned to notes in CC1, $\alpha_2$ is the central angle subtended by muzi-pads 18 assigned to notes in CC2. These parameters are further illustrated in FIG. 5.

The relationship between $\alpha_0$, $\alpha_1$, and $\alpha_2$ is defined by $\alpha_1=r_{10}\alpha_0$ and $\alpha_1=r_{20}\alpha_0$ where $r_{10}$ and $r_{20}$ are ratios chosen on the basis of note frequency. The relationship between $\rho_0$, $\rho_1$, and $\rho_2$ is defined by $\rho_1=q_{10}\rho_0$ and $\rho_1=q_{20}\rho_0$ where $q_{10}$ and $q_{20}$ are ratios again chosen on the basis of note frequency.

For the preferred embodiment of the current invention, ratios $r_{10}$ and $r_{20}$ are determined as $r_{10}=r_{20}=2^{1/3}$, which corresponds to the ratio of the average frequencies of notes assigned to any pair of adjacent chromatic clusters, such as CC0 and CC1 or CC1 and CC2, and $q_{10}=q_{20}=2$, which corresponds to the ratio of the average frequencies of notes assigned to any pair of adjacent rings, that is Ring#0 46 and Ring#1 47 or Ring#1 47 and Ring#2 48.

Visual cues for synthesized voices that do not have definite musical pitch such as rhythmic percussion instruments and special effects and which included, for example, gongs, hand-claps, drum sets are provided by placing an appropriate icon that is representative of these voices in close proximity to said relevant muzi-pad 18. For example, one can use an image of a pair of hands as an icon of a hand clap special effect. These icons are moveable, thus facilitating flexibility in user assignment of percussion instruments to said muzi-pads 18.

Figure 8:
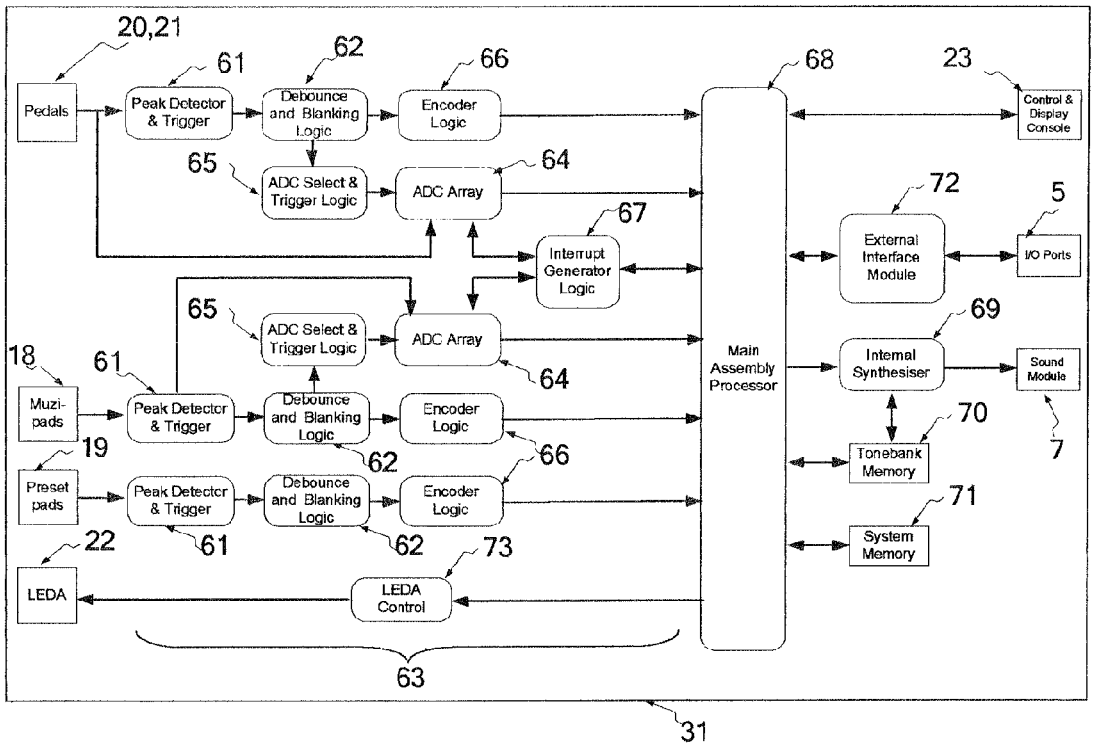
FIG. 8 shows a block diagram of the main assembly electronic circuit of the apparatus of the present invention.

Reference is now made to FIG. 8 which shows the block diagram of the preferred embodiment, of the main assembly electronic circuit 31 of the apparatus of the present invention. The block diagram follows the Gane-Sarson convention whereby data transforming processes are represented by oblong shapes, data storage areas are represented by open sided rectangles and input and output interfaces by closed rectangles. Data movement is indicated by arrows. As the FIG. 8 is a high level representation of an electronic circuit, critical control information is also represented. In this regard, the diagram varies slightly from the Gane-Sarson convention.

Although FIG. 8 is somewhat unconventional in its illustration of an electronic circuit, it provides a far less confusing disclosure of the electronic hardware of the present invention, than would the conventional electronic circuit diagram. The various blocks referenced in FIG. 8 do not represent inventive steps and are known to those skilled in the art of electronics.

TABLE 2

| | | | | | | | | | | | | | |
|---|---|---|---|---|---|---|---|---|---|---|---|---|---|
| Pad | Ring #0 | 000 | 001 | 002 | 003 | 004 | 005 | 006 | 007 | 008 | 009 | 010 | 011 |
| Number | Ring #1 | 100 | 101 | 102 | 103 | 104 | 105 | 106 | 107 | 108 | 109 | 110 | 111 |
| | Ring #2 | 200 | 201 | 202 | 203 | 204 | 205 | 206 | 207 | 208 | 209 | 210 | 211 |
| Assigned Notes (4ths/5ths) | | C | G | D | A | E | B | $F^{\#}$ | $C^{\#}$ | $A^b$ | $E^b$ | $B^b$ | F |
| Chromatic Cluster | | CC0 | CC1 | CC0 | CC2 | CC1 | CC2 | CC1 | CC0 | CC2 | CC0 | CC2 | CC1 |

The main assembly electronic circuit 31 provides the following functions: (1) Pad signal filtering to eliminate erroneous outputs from said muzi-pad 18 array and foot pedals 20, 21, (2) Real time identification of the pad number of said muzi-pad 18 that is struck, (3) Real time measurement of the force with which the identified pad has been struck, (4) Real time mapping of pad numbers of activated muzi-pads 18 to a list of user programmable characteristics associated with the identified pad, (5) Composition of the MIDI stream required for output, (6) Transmission of the MIDI stream, (7) Activation of the LEDA 22, (8) Interface with the control & display console 23, (9) Overall system management functions for proper operation of the apparatus of the present invention.

The main assembly electronic circuit 31 of the present invention, consists of the Main Assembly Interface Circuit 63, the Main Assembly Embedded Processor 68, System Memory 71 which incorporates all memory elements required for system operation save for the Tone Bank memory 70, Internal Synthesizer 69, Tone Bank Memory 70 which fully realizes the Tone bank Memory module 17 in the top level schema 1 and the External Interface Module 72.

The Main Assembly Interface Circuit 63 provides signal conditioning functions for the inputs from said muzi-pads 18, the preset pads 19 and pedals 20, 21 on the playing surface 25 and provides the resulting conditioned signals as inputs to the Main Assembly Embedded Processor 68. The aforementioned signal conditioning functions are described in more detail below. The Main Assembly Embedded Processor 68 also takes input from the MIDI wireless and wired ports, as well as the control & display console 23, to generate the MIDI wireless and wired output signals, visual feedback system signals to the LEDA 22 and control & display console 23 display signals.

The outputs of said muzi-pad interface electronic circuit 60 located on each such muzi-pad 18 are directly connected to the main assembly electronic circuit 31 using removable connectors thus facilitating replacement and repair of individual muzi-pads 18. Connection is directly to the Peak Detector and Trigger module 33 of the main assembly electronic circuit 31.

The Peak Detector & Trigger Circuitry 61 takes input from the sensors on the muzi-pads 18 and outputs a trigger pulse that is fed to the Debounce and Blanking Logic module 62 to indicate that the relevant pad has been struck, and the peak of the signal level that is inputted to an Analog to Digital Converter array (ADC array) 64 to provide an indication of the force of impact of the strike on said relevant muzi-pad 18.

There are three Peak Detector and Trigger Circuitries 61 for each such muzi-pad 18, one for each group of sensors in each of the primary strike zone 56, the circumferential strike zone 57 and the radial strike zone 58.

Figure 9:
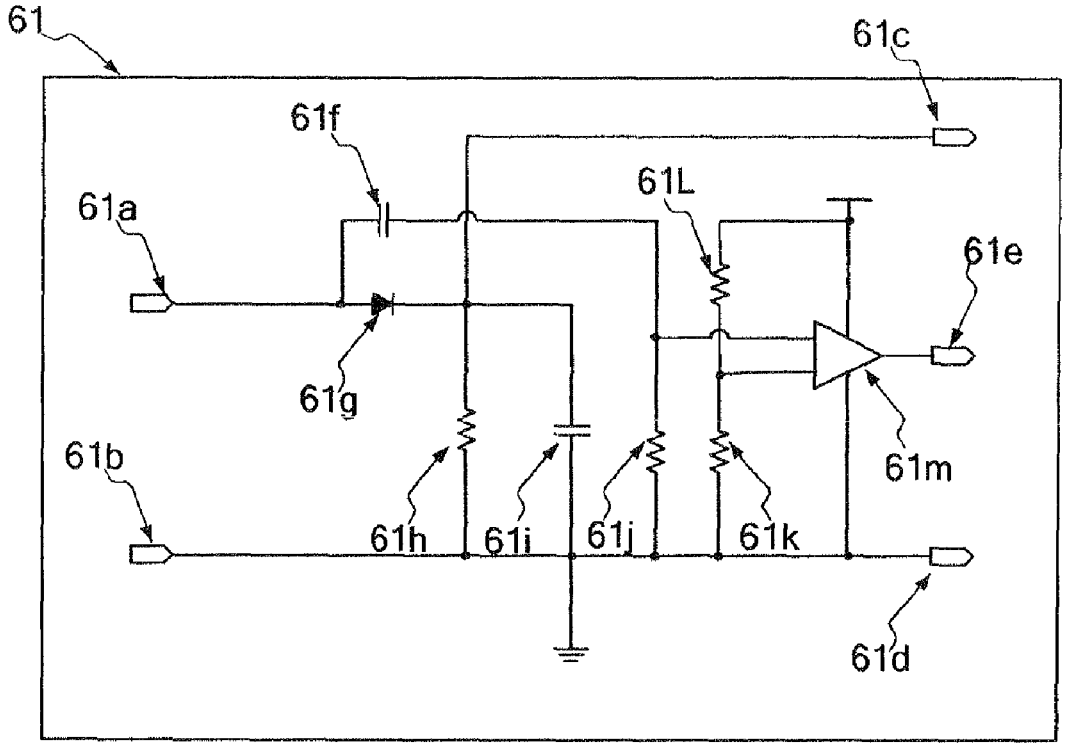
FIG. 9 depicts a preferred embodiment of the Peak Detection and Trigger Circuitry of the apparatus of the present invention.

FIG. 9 shows a schematic of a rudimentary circuit that can be used to implement the Peak Detector & Trigger Circuitry 61 the design and operation of which is known to those skilled in the field of electronics.

One of the three outputs of said muzi-pad interface electronic circuit 60 located on each such muzi-pad 18 is connected to the input terminals 61*a*, 61*b*. Positive voltages generated on said muzi-pad interface electronic circuit 60 charge the capacitor 61*i* through the diode 61*g*. The diode 61*g* ensures that charges thus stored in the capacitor 61*i* do not flow in the opposite direction, that is, back to the input source, when the voltage on the latter drops below that on the capacitor 61*i*. Alternatively, it ensures that negative going voltages generated by said muzi-pad do not discharge the capacitor 61*i*. The series combination of diode 61*g* and capacitor 61*i* therefore ensure that the capacitor is charged to the peak input voltage.

Resistor 61*h* ensures that the capacitor is discharged on the next strike of said muzi-pad 18. The value of this resistor is chosen so that the capacitor is sufficiently discharged in 50 ms thus allowing the detector to trap the peak values of strikes occurring at speeds of up to 20 strikes per second which is known to be greater than the fastest measured speed at which a conventional drummer can roll. The 50 ms period also allow sufficient time for the ADC to convert the analog peak value to its digital equivalent. The peak value is outputted across the terminals 61*c*, 61*d*.

It is known that in the normal mode of play whereby the implement used to strike said muzi-pad 18 is lifted immediately after impact, said muzi-pad 18 would generate a damped oscillatory response to a single strike. Such an output could also be generated by the natural tendency of the implement to bounce on said muzi-pad 18 surface just after the first impact. It is also known that the there will be some modes of play whereby the user would attempt to hold the playing implement against said muzi-pad 18 immediately upon the first impact. In this case the output response would be a single transient pulse.

To ensure minimum delay between the first impact and the generation of a voltage representative of the peak force of impact at the output of the Peak Detection & Trigger Circuitry 61, sensors 59 on said muzi-pad 18 are connected to the Peak Detection & Trigger Circuitry 61 in such a manner so as to ensure that the first peak in the output response is always positive. In the preferred embodiment, the material and construction of said muzi-pad 18 must is such that this response is significantly damped at a time of no more than 25 milliseconds after a stick impact. In addition, successive peaks in the output response to a single strike should be no more than 20 milliseconds apart. These times as specified are selected so as to ensure that each strike is detected when the player rolls the playing implements on any such muzi-pad 18 at or below the rate of 20 strikes per second which is known to exceed the maximum measured roll rate by professional drummers.

The capacitor 61*f* and series resistor 61*j* form a high pass filter that emphasizes the sharp transients in the input signal due to the strike on said muzi-pad 18. The filtered signal is inputted to one arm of a comparator 61*m* to which is applied to the other input a reference voltage generated by the potential divider chain formed by resistors 61L and 61*k*. The comparator output therefore generates a positive pulse when the filtered input value exceeds the reference value. The trigger pulse is outputted across terminals 61*e* and 61*d*.

Both the trigger and peak detection sub-circuits of the Peak Detector & Trigger Circuitry 61 are used for sensors in the primary strike zone 56. For the sensors in the secondary strike zones 57, 58 the trigger circuit of the Peak Detector & Trigger Circuitry 61 is not used. However the peak detector circuit of the Peak Detector & Trigger Circuitry 61 is used to indicate the excitation levels outputted by these sensors when said muzi-pad 18 is struck.

The Debounce and Blanking Logic module 62 is used to validate the occurrence of a strike by eliminating the aforementioned parasitic effect of multiple pulses generated by the sensor in response to a single strike. Without the Debounce and Blanking Logic 62, these multiple pulses could easily be erroneously interpreted by the fast processing electronics in the main assembly electronic circuit 31 as a multiple strike. This module is not required for sensors, such as hall effect sensors, that inherently feature a debounce capability but will none the less function if this switch technology is used. The output of the Debounce and Blanking Logic 62 is fed to an Encoder Logic module 66 that encodes the relevant pad number for input to the Main Assembly Embedded Processor 68.

Contemporaneously with the pad number encoding, a trigger activation signal is outputted by the Debounce and Blanking Logic 62 to the ADC Select and Trigger Logic module 65. Said module outputs a signal to start the data conversion process in the ADC array 64. Said array contains an ADC that will be selected by the Debounce and Blanking Logic 62 to convert the analog value of the peak height to a digital word. This information is encoded on the data output of the ADC in the ADC array 64 for input to the Main Assembly Embedded Processor 68.

The Interrupt Generator Logic 67 monitors all Analog-to-Digital Converters in the ADC array 64 for completion of their respective data conversion cycles and signals the Main Assembly Embedded Processor 68 to access the identity of said muzi-pad 18 that was struck from the output of the Encoder Logic module 66 and to read the corresponding digital word representing the force magnitude of the strike from the relevant Analog-to-Digital Converter in the ADC array 64.

The Interrupt Generator Logic 67 takes inputs from the end-of-conversion output flag of Analog-to-Digital Converters in the ADC array 64 and generates an interrupt request to the Main Assembly Embedded Processor 68. Said processor is programmed to identify said muzi-pad 18, preset pad 19 or pedal 20, 21 that has been activated and to read the data values corresponding to said muzi-pad 18 output peak value or pedal 20, 21 output as necessary.

After the Main Assembly Embedded Processor 68 reads the output of the selected Analog to Digital Converter in the ADC array 64, it sends an acknowledgement to the Interrupt Generator Logic 67 which then clears the end-of-conversion output flag of Analog-to-Digital Converters in the ADC array 64. It then transmits MIDI commands through the External Interface module 72 to appropriately configured MIDI devices connected to the I/O Ports interface 5. In the preferred embodiment of the apparatus of the present invention the I/O Ports interface 5 would implement a wired MIDI OUT port and a MIDI wireless port.

The generated MIDI stream can also be directed to an Internal Synthesis module 69 that is facilitated by implementation of Tone Bank memory 70 on standard removable memory, such as Secure Digital (SD) or Smart Media (SM) cards, or on a USB memory key.

I/O Ports 5 on the present invention, support connection to external devices using standard MIDI, USB, Firewire and Ethernet protocols. Wireless MIDI is also featured. These inherent characteristics not only allow for optimal flexibility in MIDI communication, but also facilitate the download of performance material, including MIDI sequences and tone banks, as well as software and firmware upgrades for itinerant players. The latter facility, in particular, allows the apparatus of the present invention to be adapted to new MIDI protocols, as they are published by the MIDI Manufacturers Association.

Except for minor changes, the Main Assembly Embedded Processor 68 operates on inputs from the pedals 20, 21 in similar fashion as for said muzi-pads 18. In particular, for pedals 20, 21 with continuous analog outputs, said outputs are fed directly to an Analog-to-Digital Converter in the ADC array 64. This will apply, for example, to pedals 20, 21 that are capable of such outputs and are configured as volume controls.

In addition, the peak detector circuit of the Peak Detector & Trigger module 61 is replaced by a non-inverting unity gain buffer, the design of which is known to those skilled in the art of electronic design. The output of this buffer is connected to the ADC array 64 to provide an indication of pedal activation when the pedal 20, 21 is used as a volume control or as a pitch wheel. The trigger circuit of the Peak Detector & Trigger module 61 provides a trigger output that signals that when the pedal has passed a preset reference point along its travel. This point is determined by the reference value set by the potential divider network formed by resistors 61*k*, 61*l* in FIG. 9.

Except for minor changes, the Main Assembly Embedded Processor 68 operates on preset pads 19 in similar fashion as for said muzi-pads 18 except that there are no connections to the ADC array 64 nor is the peak detector circuit of the Peak Detector & Trigger module 61 utilized. Only the trigger circuit of the Peak Detector & Trigger module 61 is utilized to indicate the occurrence of a preset pad 19 strike.

The LEDA 22 is driven by the LEDA Control Module 73 which takes as its input MIDI data streams transmitted by the Main Assembly Embedded Processor 68. Selection of the specific light emitting device in the LEDA 22 that is to be activated is determined from note information embedded in the MIDI stream and the user programmed configuration of said muzi-pads 18 that maps said muzi-pads 18 to notes. The MIDI stream source can be internal, as generated by said muzi-pads 18 when in diagnostic mode, or external, as generated by another MIDI device on the wired or wireless MIDI network when in tutor mode.

Logic modules in the Main Assembly Interface Circuit 63 can be implemented using any available digital electronic technology, including Field Programmable Gate Arrays (FPGAs), Application Specific Integrated Circuits (ASIC), or an array of embedded processors. The preferred implementation utilizes an FPGA with embedded processor cores to implement all aspects of the Main Assembly Processor 68 as well as the Main Assembly Interface Circuit 63 except for the Peak Detector & Trigger module 61 and the ADC array 64. This facilitates processing speed and therefore low latency at reasonable cost.

Figure 10:
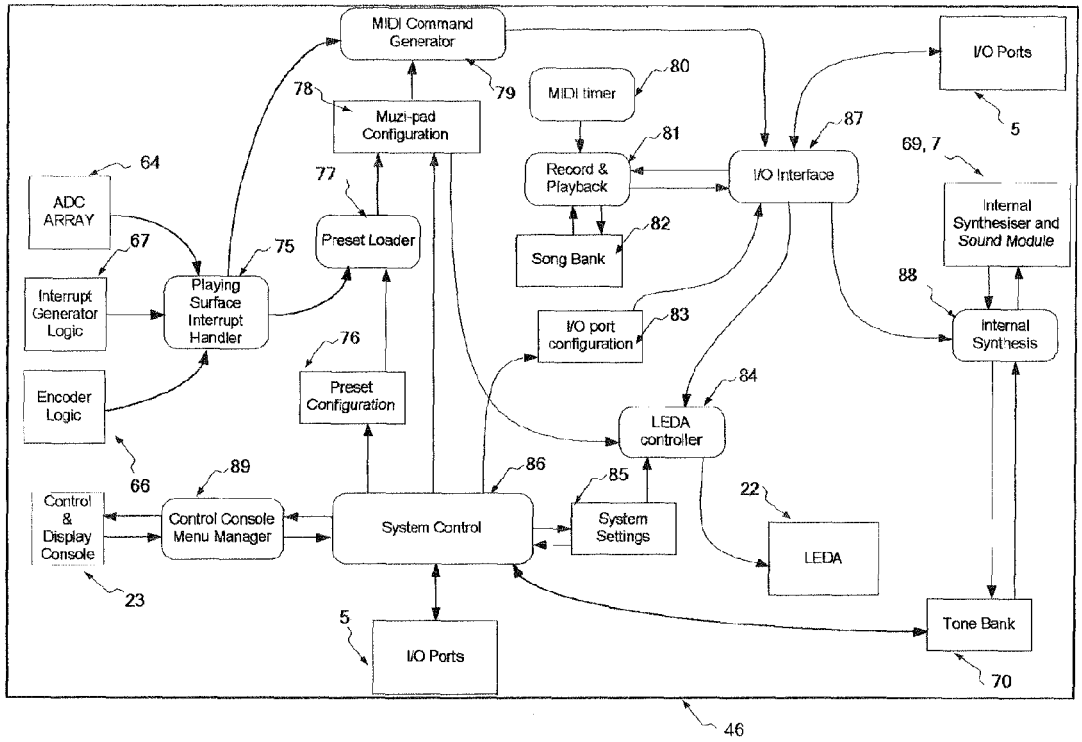
FIG. 10 is a preferred embodiment of the Main Assembly Embedded processor software data-flow diagram (DFD), of the apparatus of the present invention.

The Main Assembly Embedded Processor 68 software data flow diagram 74 (DFD) of FIG. 10, employs the Gane-Sarson convention whereby data transforming processes are represented by oblong shapes, data storage areas are represented by open sided rectangles and input and output interfaces by closed rectangles. Data movement is indicated by arrows.

The Activated Pedal Validation & ID processes 8, the Activated Muzi-pad Validation, ID & Level Detection 9 and the Activated Preset Validation & ID 10 shown in the top level schema 1 of FIG. 3 are implemented in the Playing Surface Interrupt Handler process 75 in the Main Assembly Embedded processor software DFD 74 of FIG. 10.

The MIDI String Builder process 11 in the top level schema 1 is directly implemented as the MIDI Command Generator 79 in the Main Assembly Embedded processor software DFD 74 of FIG. 10.

Software components of the Internal Synthesis process 13 in the top level schema 1 are embodied in the Internal Synthesis Process 88 of FIG. 10.

The various tasks of the System Control and Configuration process 12 shown in the top level schema 1 of FIG. 7 are distributed between the System Control Process 86, I/O Interface Process 87, Preset Loader Process 77 and the LEDA Controller Process 84 in the Main Assembly Embedded processor software DFD 46 of FIG. 10.

The various tasks in the MIDI Data Record & Playback Process 14 in FIG. 1 are implemented in the Record & Playback Process 81 and MIDI Timer Process 80 in FIG. 10.

The Configuration 16 data storage for the present invention, shown in the top level schema 1 of FIG. 1 is distributed between the System Settings memory 85, Preset Configuration memory 76, Muzi-pad Configuration memory 78 and I/O Port Configuration memory 83 elements in the Assembly Embedded processor software DFD 46 of FIG. 10. The Tone Bank Memory 17 and Song Bank Memory 15 shown in the top level schema 1 of FIG. 1 are directly realized as the Tone Bank Memory 70 and Song Bank Memory 82 in the Assembly Embedded processor software DFD 46 of FIG. 10.

The Playing Surface Interrupt Handler process 75 is activated by the Interrupt Generator Logic 67 in the main assembly electronic circuit 31. This signals the availability of new data from said muzi-pads 18 or preset pads 19 on the playing surface 25. When the interrupt is received the Playing Surface Interrupt Handler process 75 identifies the source of the interrupt as either the preset pads 19 or said muzi-pads 18 using the data presented by the Encoder Logic 66. The use of interrupts facilitates fast and reliable capture and processing of pad strike events.

If the source of the interrupt is identified as the preset pads 19, the number of the activated pad is obtained from the preset number data output from the encoder 38.

If the source of the interrupt is identified as a muzi-pad 18, the Playing Surface Interrupt Handler 75 identifies the note struck by reading said muzi-pad number data output from the Encoder Logic 66 in the main assembly electronic circuit 31. It then samples the note level by reading the output of the ADC array 64. It then obtains the number of any pedal 20, 21 that is depressed by reading the pedal 20, 21 number data output from the encoder 38 in the main assembly electronic circuit 31. Finally, it reads the output of the secondary sensors in said relevant muzi-pad 18 corresponding to the circumferential strike zones 57 and the Radial strike zones 58.

All of this data is then communicated to the MIDI Command Generator process 79.

The MIDI Command Generator 79 constructs MIDI command data streams based on the information received from the Playing Surface Interrupt Handler 75 using current configuration data in the Muzi-pad Configuration memory 78. The data in this area is arranged as a programmable matrix that maps each muzi-pad 18 to a user specified assignment of note properties, including, inter alia, note, voice, MIDI channel, SSAF and MSSV. Capabilities such as variable timbre, chords and multi-voice settings are also accommodated in the MIDI Command Generator 79.

The Muzi-pad Configuration storage memory 78 accepts data from the Preset Loader process 77 or the System Control process 86. The System Control process 86 stores data in the Muzi-pad Configuration storage memory 78 based on user input from the Control & Display Console. It also populates the Preset Configuration memory 76 with preset configuration data for each numbered preset as determined by the user. The Preset Loader process 77 is responsible for retrieving the muzi-pad 18 data stored in the Preset Configuration memory 76 corresponding to the preset number information transmitted from the Playing Surface Interrupt Handler 75 and writes the data into the Muzi-pad Configuration memory 78. This facilitates the automatic and dynamic reconfiguration of the system.

MIDI command data streams are then forwarded to the I/O Interface process 87, which transmits these MIDI commands through on one or more channels in the I/O ports interface 5. The role of the I/O Interface process 87 is to format the MIDI stream for transmission through whatever output channel is selected by the user. MIDI output from the I/O Interface process 87 can also be directed to the Internal Synthesis Process 88, or the LEDA Controller process 84. The I/O Interface process 87 uses information in the I/O Port Configuration memory 83 to identify MIDI IN and MIDI OUT channel numbers selected by the user and to determine if the internal synthesizer 69 and/or the LEDA 22 are to be disabled.

The LEDA Controller 84 process is responsible for controlling the ON/OFF status of each light emitting device 22 on the playing surface 25. It accepts input from the playing surface 25 or from the current MIDI IN port through the I/O Interface process 87. The LEDA controller obtains its operating status from the System Settings memory 85. This status includes its active state, ON or OFF, whether it is in Tutor or Diagnostic mode and the source of the MIDI data stream as internal or external via the active MIDI port.

The System Control process 86 uses the Control Console Menu Manager, to input and display current configuration settings of the present invention. The Control Console Menu Manager process 89 controls the interactive display and user input on the control & display console 23. In the preferred implementation of the present invention, the user interface implements a page based menu structure as hereinafter described.

The Record & Playback process 81, when activated by the user, stores MIDI stream data along with time stamp information, from the MIDI timer process 80 in the Song Bank memory 82. Songs stored in the Song Bank 82 can be retrieved by the Record & Playback process 81 for playback through by the I/O Interface process 87. The I/O Interface process 87, can also blend the playback MIDI stream from the Record & Playback process 81 with new MIDI stream data generated by the user from the muzi-pads 18 on the playing surface 25. This allows a player to lay down a beat track, for example, which can then be replayed as accompaniment. The MIDI Timer process 80 is also used to implement a metronome feature through the Internal Synthesis process 88.

The Record & Playback process 81 is also used to retrieve rhythm MIDI sequences from the Song Bank 82. In this regard, the Song Bank 82 is partitioned into four sections (a) User programmable Song Storage which facilitates the storage of user generated or user downloaded sequences as described above; (b) User programmable Rhythm Storage which operates similarly as the user programmable Song Storage section but is specifically identified for Rhythm patterns; (c) APHAMS Song Storage where predefined sequences are stored and which cannot be erased by the user and (d) APHAMS Rhythm Storage where predefined rhythm sequences are stored and which cannot be erased by the user.

The electronic hardware and software subsystems described above for the apparatus of the present invention empower the implementation of a plurality of capabilities that can be accessed through the system menu as presented on the control & display console 23.

Reference is now made to Table 3, Table 4 and Table 5 below which provide a typical list of the user selectable options available for the present invention. The preferred embodiment would implement these options as a page based menu displayed on the control & display console 23.

Said menu is depicted using a nested structure, of the form:

Item 1 {item a {Item I, Item II}, Item b} whereby submenus of a menu item higher up in the hierarchy are enclosed in curly brackets. Menu items shown in bold are actually implemented as top level menu items elsewhere in the menu structure and can therefore be accessed independently. In the example, Item a and Item b are sub-menus of Item1 with Item a including submenus Item I and Item II.

When a given user enters a new category on the menu, the current setting is displayed as a starting point. An EXIT prompt is available to save or cancel the selections made. The original values are restored if CANCEL is selected. These are common to all menu items and are not shown in herewithin Tables 3, 4 and 5. An option is provided whereby a menu is exited if there is no input for a time determined by the user; the default is set to 10 seconds. All menu configurations are saved on power down in nonvolatile memory.

In addition there is a RING SELECT submenu item that appears throughout the structure and which facilitates the application of all appropriate settings listed at the level where it appears to a specific ring, by selecting Ring#0 46, Ring#1 47 or Ring#2 48, or simultaneously to all rings, by selecting ALL, the system default. This facilitates the implementation of a split feature whereby each ring may have its own musical range or voice.

The top level of the menu structure provides for four main groups of options (a) PLAYING SURFACE, (b) TONES, (e) SYSTEM CONFIGURATION and (d) RECORD/PLAYBACK.

The PLAYING SURFACE menu item has four submenus: RING_SELECT, RANGE, LAYOUT and SAVE TO PRESET.

If ALL is selected in the RING SELECT sub-menu the RANGE submenu allows the user to set the lowest note for the entire apparatus. This is allocated to muzi-pad 18 000. The notes on the inner rings will then be automatically set an octave higher for Ring#1 46 and two octaves higher for Ring #2 48. The submenu eaters for all eight octaves corresponding to any one C0, C1, C2, C3, C4, C5, C6 or C7. If individual rings are selected in the RING SELECT submenu, the RANGE submenu sets the lowest note on the selected ring. For the current invention this will always be a C note corresponding to muzi-pad 18 R00, where R is the ring number.

The LAYOUT submenu facilitates the selection of note layout styles. The selections provided are 4ths and 5ths, chromatic and custom. The custom selection facilitates arbitrary assignment to each individual muzi-pad 18 a unique note specified by octave number, spanning octaves 0 to 8, and note, spanning C to B.

The SAVE TO PRESET submenu allows the user to save current settings in the PLAYING SURFACE menu, to one of several physical and virtual presets. The user must select a preset group and a preset number, corresponding to any one of the virtual or physical preset buttons, pads or pedals.

The TONES menu item allows for quick and direct access to synthesized voices as well as the chord, multi-voice and timbre generation capabilities of the apparatus of the present invention. The RING SELECT submenu of the TONES menu facilitates application of selected TONE menu options to any one of or all of the rings.

The VOICE sub-menu provides access to MIDI patch names and codes as per General MIDI designation and as listed in Table 4. Every new voice selection causes the operating software to send a MIDI Patch Change command to the MIDI device on the channel assigned to the relevant ring or rings. Both General MIDI names and codes are displayed. The sub menu lists the standard GM voice selection by standard General MIDI designated groupings: Piano, Chromatic Percussion, Organ, Guitar, Bass, Strings, Ensemble, Brass, Reed, Pipe, Synth Lead, Synth Pad, Synth effects, Ethnic, Percussive, Sound Effects.

In addition, the user can select any one of the standard steelpan ranges under the STEELPAN submenu selection. In the simplest implementation of the current invention, selection of any of the options listed under this item sets the voice to General MIDI Steel Drum, MIDI code 115, the layout as 4ths and 5ths and the lowest note as follows: Tenor—C4, Double Tenor—C3, Double Second—C3, Guitar—C2, Cello—C2, Quadraphonic—C2, Tenor Bass—C1, six-Bass—C1. The lowest note is a C and is placed on muzi-pad 000. This allows rapid configuration of the present invention for acoustic steelpan emulation and synthesis.

Acoustic steelpans with similar ranges differ somewhat in the timbre produced. For example, a tenor bass does not emphasize the lower partials as much as does the six (6) bass for notes that are common on both instruments. It is therefore acknowledged that the synthesis of the traditional instrument, will be somewhat flawed if the same MIDI voice is used for all ranges. In the preferred embodiment, this problem is solved through more accurate internal synthesis of each steelpan instrument or by use of the sampling feature available in many commercial MIDI synthesizers.

Selection of the DRUM submenu, configures the present invention to send commands on Channel 10, which is allocated for General MIDI Drums. The preferred embodiment assigns muzi-pads for Drum/Percussion is shown in Table 5.

Users can also enter MIDI codes directly using the VOICE menu, allowing the user to use MIDI devices with mappings that differ from the GM patch map. Many MIDI sound modules will require that these be accessed by specifying the relevant MIDI bank number; the user can do this through the MIDI submenu item under the SYSTEM CONFIGURATION menu.

TABLE 3

| | |
|---|---|
| Playing Surface | {<br>Ring Select{ALL, 0,1,2..}<br>Range{$C_0$, $C_1$, $C_2$, $C_3$, $C_4$, $C_5$, $C_6$, $C_7$}<br>Layout {4/5 (default), Chromatic, Custom{Pad Select{000, 001,...,200, ...211},<br>Octave_Number{0,1,2...8}, Note{C, $C^{\#}$, D, $E^{b}$, E, F, $G^{\#}$, G, $G^{\#}$, A, $B^{b}$,<br>B}}<br>Save To Preset{ Group{1,2,...}, Preset{V1,...V8, P1,...P4, Pedal 0, Pedal 1}}<br>} |
| Tones | {<br>Ring Select{ALL, 0,1,2..},<br>Voice{Steelpan{6-Bass, Tenor Bass, Guitar/Cello, Double Second, Double Tenor,<br>Tenor},<br>General MIDI Voices{1-28 in GM Groups of 8*},<br>Drums**,<br>Code{1-128}<br>},<br>Multi-Voice{ON/OFF, Voice, Volume}<br>Chords{ ON/OFF, Select{selection of major and minor chords}}<br>Timbre{ ON/OFF, SSAF, MSSV}<br>Save To Preset{ Group{1,2,...}, Preset{V1,...V8, P1,...P4, Pedal 0, Pedal 1}} |

TABLE 3-continued

| | |
|---|---|
| | } |
| System Configuration | |
| | { |
| | Pedals{Volume, Sustain, Pitch Bend, Synch Intro, Synch Ending, Preset{Pedal 0, Pedal 1}} |
| | MIDI_set{ Ring Select{ALL, 0,1,2..}, OUT_Channel{1-16}, IN_Channel{1-16}, Bank{1-127}, Port{MIDI, Ethernet, USB, Firewire }} |
| | LEDA{ON/OFF, Tutor, Diagnostic, Source{APHAMS, MIDI}} |
| | Synthesis{ Internal{ON/OFF}, External{ON,OFF}, ToneBank{Internal, Card, Update{Source{External{MIDI}, Card}}, } |
| | Display {BackLight{ON/OFF}, Contrast{min,..max}} |
| | Menu Timeout{NONE, Time{1,...,10}} |
| | Software Update{ON/OFF} |
| | } |
| Record/Playback | |
| | { |
| | Status{Start, Stop}, |
| | Song{ Group1{1...$n_{songs}$}, ...Group n{1...$n_{songs}$} } |
| | User Song{Group1{1...$n_{songs}$}, ...Group n{1...$n_{songs}$}, Card{1...}} |
| | Record{Source{APHAMS, Card{1...}, External }, Destination{Group1{1...$n_{songs}$}, ...Group n{1...$n_{songs}$}} } |
| | Rhythm{Select{Group1{1...$n_{songs}$}, ...Group n{1...$n_{songs}$}} } |
| | Tempo{1-128} |
| | Metronome{OFF, ON} |
| | } |

*See Table 3
**See Table 4

TABLE 4

| PIANO |
|---|
| 1. Acoustic Grand |
| 2. Bright Acoustic |
| 3. Electric Grand |
| 4. Honky-Tonk |
| 5. Electric Piano 1 |
| 6. Electric Piano 2 |
| 7. Harpsichord |
| 8. Clavinet |
| CHROMATIC PERCUSSION |
| 9. Celesta |
| 10. Glockenspiel |
| 11. Music Box |
| 12. Vibraphone |
| 13. Marimba |
| 14. Xylophone |
| 15. Tubular Bells |
| 16. Dulcimer |
| ORGAN |
| 17. Drawbar Organ |
| 18. Percussive Organ |
| 19. Rock Organ |
| 20. Church Organ |
| 21. Reed Organ |
| 22. Accordion |
| 23. Harmonica |
| 24. Tango Accordion |
| GUITAR |
| 25. Nylon String Guitar |
| 26. Steel String Guitar |
| 27. Electric Jazz Guitar |
| 28. Electric Clean Guitar |
| 29. Electric Muted Guitar |
| 30. Overdriven Guitar |
| 31. Distortion Guitar |
| 32. Guitar Harmonics |
| BASS |
| 33. Acoustic Bass |
| 34. Electric Bass (fingered) |

TABLE 4-continued

| |
|---|
| 35. Electric bass (pick) |
| 36. Fretless Bass |
| 37. Slap Bass 1 |
| 38. Slap Bass 2 |
| 39. Synth Bass 1 |
| 40. Synth Bass 2 |
| SOLO STRINGS |
| 41. Violin |
| 42. Viola |
| 43. Cello |
| 44. Contrabass |
| 45. Tremolo Strings |
| 46. Pizzicato Strings |
| 47. Orchestral Strings |
| 48. Timpani |
| ENSEMBLE |
| 49. String Ensemble 1 |
| 50. String Ensemble 2 |
| 51. SynthStrings 1 |
| 52. SynthStrings 2 |
| 53. Choir Aahs |
| 54. Voice Aahs |
| 55. Synth Voice |
| 56. Orchestra Hit |
| BRASS |
| 57. Trumpet |
| 58. Trombone |
| 59. Tuba |
| 60. Muted trumpet |
| 61. French Horn |
| 62. Brass Section |
| 63. SynthBrass 1 |
| 64. SynthBrass 2 |
| REED |
| 65. Soprano Sax |
| 66. Alto Sax |
| 67. tenor Sax |
| 68. Baritone Sax |
| 69. Oboe |
| 70. English Horn |

TABLE 4-continued

| |
|---|
| 71. Bassoon |
| 72. Clarinet |
| PIPE |
| 73. Piccolo |
| 74. Flute |
| 75. Recorder |
| 76. Pan Flute |
| 77. Blown Bottle |
| 78. Skakuhachi |
| 79. Whistle |
| 80. Ocarina |
| SYNTH LEAD |
| 81. Square |
| 82. Sawtooth |
| 83. Calliope |
| 84. Chiff |
| 85. Charang |
| 86. Voice |
| 87. fifths |
| 88. Bass + Lead |
| SYNTH PAD |
| 89. New Age |
| 90. Warm |
| 91. Polysynth |
| 92. Choir |
| 93. Bowed |
| 94. Metallic |
| 95. Halo |
| 96. Sweep |
| SYNTH EFFECTS |
| 97. Rain |
| 98. Soundtrack |
| 99. Crystal |
| 100. Atmosphere |
| 101. Brightness |
| 102. Goblins |
| 103. Echoes |
| 104. Sc-fi |
| ETHNIC |
| 105. Sitar |
| 106. Banjo |
| 107. Shamisen |
| 108. Koto |
| 109. Kalimba |
| 110. bagpipe |
| 111. Fiddle |
| 112. Shanai |
| PERCUSSIVE |
| 113. Tinkle Bell |
| 114. Agogo |
| 115. Steeldrums |
| 116. Woodblock |
| 117. Taiko Drums |
| 118. Melodic Tom |
| 119. Synth Drum |
| 120. Reverse Cymbal |
| SOUND EFFECT |
| 121. guitar Fret Noise |
| 122. Breath Noise |
| 123. Seashore |
| 124. Bird Tweet |
| 125. telephone Ring |
| 126. Helicopter |
| 127. Applause |
| 128. Gunshot |

TABLE 5

| Pad | GM Drum/ Percussion | MIDI Code |
|---|---|---|
| 000 | Kick | 36 |
| 001 | Snare | 38 |
| 002 | Hi-Hat Open | 46 |
| 003 | Hi Hat Closed | 42 |
| 004 | Chin Cymbal | 72 |
| 005 | Low Tom | 45 |
| 006 | Mid Tom H | 47 |
| 007 | Mid Tom L | 48 |
| 008 | High Tom | 50 |
| 009 | RideCymb1 | 51 |
| 010 | Tambourine | 54 |
| 011 | Side Stick | 37 |
| 100 | Agogo L | 68 |
| 101 | Bongo L | 61 |
| 102 | Bongo H | 60 |
| 103 | Cowbell | 56 |
| 104 | Crash Cymbal | 49 |
| 105 | Jingle Bells | 83 |
| 106 | Cabasa | 69 |
| 107 | Timbale H | 65 |
| 108 | Timbale L | 66 |
| 109 | RideCymb2 | 59 |
| 110 | Hand Clap | 39 |
| 111 | Agogo H | 67 |
| 200 | OpenRimSt | 34* |
| 201 | | |
| 202 | FingerSnap | 19* |
| 203 | | |
| 204 | ClickNoise | 20* |
| 205 | | |
| 206 | Wood BlkL | 77 |
| 207 | Wood BlkH | 76 |
| 208 | | |
| 209 | | |
| 210 | | |
| 211 | | |

*Yamaha XG format only

The CHORDS submenu allows the user to switch the Chords option off or on. When on, the selected rings are configured for single stick chord play, whereby each muzi-pad in the relevant ring plays a designated chord when struck.

The MULTI-VOICE submenu allows the user to simultaneously play two or more voices, when a single muzi-pad is struck. When enabled, the user is required to select the voices required from the VOICE submenu.

The TIMBRE submenu item allows the user to enable or disable the variable timbre feature of the present invention and also provides for adjustment of the SSAF and MSSV parameters that determine the levels of the notes triggered by the sensors in the secondary strike zones 28, 29.

The SAVE TO PRESET submenu, allows the user to save current relevant settings to one of several physical and virtual presets. The user must select a preset group and a preset number corresponding to any one of the virtual or physical preset buttons, pads or pedals.

The SYSTEM CONFIGURATION menu allows the user to set up general features of the present invention. This includes settings for the foot pedals 20, 21, the LEDA 22, synthesis device, MIDI, control & display console 23, and the menu.

The PEDALS submenu allows the user to assign the foot pedals 20, 21 to function as controls for volume, damp effect, sustain effect, pitch bend, rhythm control for changing rhythm sequences at the start or end of a song, or a preset switch.

The MIDI_SET submenu facilitates setup of the MIDI ports and channel numbers. Channel numbers can be specified for an external MIDI device to which MIDI commands can be sent. The RING SELECT submenu facilitates application of selected MIDI_SET submenu options to any one of or all of the rings.

The IN_Channel submenu is used to set the channel number for the present invention; this is the channel number on which it listens for input MIDI commands for the array of light emitting devices.

The OUT_CHANNEL submenu facilitates the selection of the channel numbers on which the present invention transmits MIDI information.

The BANK submenu allows the user to specify a MIDI bank in the currently addressed MIDI device. This facilitates access to manufacturer specific tones and features on external MIDI devices.

The PORT submenu facilitates selection of the physical port to be used for MIDI communication. The preferred embodiment facilitates communication through standard MIDI, Ethernet, Firewire or USB and identifies to the user all ports that are actually connected to an external MIDI device.

The LEDA submenu allows the user to enable or disable the LEDA 22, select its operational mode as tutor or diagnostic and to select the source channel for MIDI input to the array of light emitting devices. The latter could be the present invention or an external MIDI device.

The SYNTHESIS submenu facilitates the selection of an external MIDI synthesizer, or the internal synthesizer of the present invention. It also facilitates the selection and update of the synthesizer tone bank. Updates can be obtained from a memory card, or an external source through MIDI.

The DISPLAY submenu allows for the adjustment of control & display console 23 backlighting and contrast levels.

The MENU TIMEOUT submenu allows the user to set the time out period for menu displays. The top level menu screen is displayed after this period has elapsed.

The SOFTWARE UPDATE submenu facilitates the download of upgraded firmware for the present invention and software from the user's computer.

The RECORD/PLAYBACK menu facilitates the recording and playback of MIDI sequences stored on the present invention.

The STATUS submenu starts recording or playback of any items selected on the other submenus. Four beats are given at the selected tempo to cue the start of the required action.

The SONG submenu allows access to stored MIDI songs. Each song is identified by a group name or number and a song name or number. Songs listed in this submenu are permanently stored in song memory of the present invention.

The USER SONG submenu allows access to MIDI songs recorded and stored by the user in song memory of the present invention, or on the external memory card.

The RECORD submenu facilitates the storage of MIDI sequences generated by the user as the present invention is played, or from a remote source. The SOURCE submenu allows the user to select the MIDI source for recording as APHAMS, the external card storage or from an external source whose address must is specified by the IN_CHANNEL setting in the MIDI_SET menu item. The DESTINATION submenu allows the user to select the location in user memory where the recording will be stored for later access from the USER SONG submenu.

The RHYTHM submenu facilitates convenient selection of one of several rhythms stored as MIDI songs and arranged in convenient groupings.

The TEMPO submenu allows the user to specify the tempo for recording and playback.

The METRONOME submenu can be used to toggle the metronome off or on.

Whilst the present invention has been described in connection with certain preferred embodiments, it is to be understood that the subject matter encompassed by way of the present invention, is not to be limited to those specific embodiments and that various other modifications may be made to the construction of the apparatus of the present invention, involving other modifications and changes, which may be varied to fit particular operating requirements and environments, which will be apparent to those skilled in the art and that the present invention, is not considered to be limited to the herewithin instant examples chosen for the purposes of disclosure.

On the contrary, it is intended for the subject matter of the present invention to include all alternatives, modifications and equivalents, which do not constitute departures from its true spirit and scope, as can be included within the spirit and scope of the following claims.

GLOSSARY

| | |
|---|---|
| 1 | Top Level Schema |
| 2 | Playing Surface Inputs Section |
| 3 | Main Operational Processes |
| 4 | Additional Interfaces |
| 5 | I/O Ports Interface |
| 7 | Sound Module Output Interface |
| 8 | Activated Pedal Validation & ID process |
| 9 | Activated muzi-pad validation, ID and Level Detection process |
| 10 | Activated Preset Validation & ID process |
| 11 | MIDI String Compiler Process |
| 12 | System Control and Configuration process |
| 13 | Internal Synthesis process |
| 14 | MIDI Data Record & Playback process |
| 15 | Song Bank Memory |
| 16 | APHAMS Configuration Memory |
| 17 | Tone Bank memory |
| 18 | Muzi-pad |
| 19 | Preset pads |
| 20 | Sustain Pedal |
| 21 | Damp Pedal |
| 22 | Light Emitting Device/LEDA |
| 23 | Control & Display Console |
| 24 | Main Assembly |
| 25 | Playing Surface |
| 26 | Main Assembly Chassis |
| 27 | Mounting Stand |
| 28 | Connector Pod |
| 29 | Rocker Arm/Attitude Lock Assembly |
| 30 | Mounting Stand Locking Hinge |
| 31 | Main Assembly Electronic Circuit |
| 32 | Control & Display Console Recess |
| 33 | Muzi-Pad Recess |
| 34 | Rocker Arm Support |
| 35 | Rocker Arm Bearing |
| 36 | Attitude Lock |
| 37 | Ratchet |
| 38 | Pawl |
| 39 | Spring |
| 40 | Bracing Pin |
| 41 | Counterweight |
| 42 | Attitude Lock Body |
| 43 | Attitude Lock Handle |
| 44 | Attitude Lock Handle Pivot |
| 45 | Rocker Arm |
| 46 | Ring #0 |
| 47 | Ring #1 |
| 48 | Ring #2 |
| 49 | Top View |
| 50 | Exploded Front View |
| 51 | Bottom View |
| 52 | Muzi-pad Frame |
| 53 | Muzi-pad Shell |
| 54 | Impact Filter Pad |
| 55 | Vibration Absorbing Mount |
| 56 | Primary Strike Zone |

-continued

| GLOSSARY | |
|---|---|
| 57 | Circumferential Strike Zones |
| 58 | Radial Strike Zones |
| 59 | Muzi-pad Sensors |
| 60 | Muzi-Pad Interface Electronic Circuit Board |
| 60a | Muzi-Pad Interface Electronic Circuit Input Signal Terminal |
| 60b | Muzi-Pad Interface Electronic Circuit Input Ground Terminal |
| 60c | Muzi-Pad Interface Electronic Circuit FET |
| 60d | Muzi-Pad Interface Electronic Circuit Gate Resistor |
| 60e | Muzi-Pad Interface Electronic Circuit Source Resistor |
| 60f | Muzi-Pad Interface Electronic Circuit Output Signal Terminal |
| 60g | Muzi-Pad Interface Electronic Circuit Output Ground Terminal |
| 60h | Muzi-Pad Interface Electronic Circuit Power Supply Terminal |
| 61 | Peak Detector & Trigger Circuitry |
| 61a | Peak Detector & Trigger Input Signal Terminal |
| 61b | Peak Detector & Trigger Input Signal Ground Terminal |
| 61c | Peak Detector Output Signal Terminal |
| 61d | Peak Detector & Trigger Output Ground Terminal |
| 61e | Trigger Circuit Output Signal Terminal |
| 61f | Trigger Circuit High Pass Filter Capacitor |
| 61g | Peak Detector Diode |
| 61h | Peak Detector Discharge Resistor |
| 61i | Peak Detector Charge Capacitor |
| 61j | Trigger High pass Filter Resistor |
| 61k | Trigger Circuit Lower Potential Divider Resistor |
| 61L | Trigger Circuit Upper Potential Divider Resistor |
| 61m | Trigger Circuit Comparator |
| 62 | Debounce and Blanking Logic |
| 63 | Main Assembly Interface Circuit |
| 64 | Analog to Digital Converter Array/ADC Array |
| 65 | ADC Select and Trigger Logic |
| 66 | Encoder Logic |
| 67 | Interrupt Generator Logic |
| 68 | Main Assembly Embedded Processor |
| 69 | Internal Synthesiser |
| 70 | Tone Bank Memory |
| 71 | System Memory |
| 72 | External Interface Module |
| 73 | LEDA Control |
| 74 | Main Assembly Embedded Processor Software Data Flow Diagram |
| 75 | Playing Surface Interrupt Handler |
| 76 | Preset Configuration Memory |
| 77 | Preset Loader Process |
| 78 | Muzi-pad Configuration Memory |
| 79 | MIDI Command Generator Process |
| 80 | MIDI Timer Process |
| 81 | Record & Playback Process |
| 82 | Song Bank |
| 83 | I/O port Configuration Memory |
| 84 | LEDA Controller Process |
| 85 | System Settings Memory |
| 86 | System Control Process |
| 87 | I/O Interface Process |
| 88 | Internal Synthesis Process |
| 89 | Control Console Menu Manager Process |

What is claimed is:

1. An Apparatus for Percussive Harmonic Musical Synthesis (APHAMS) characterized by said apparatus utilizing electronics to generate melodic sound, bearing tone and note pitch, by the striking of a plurality of note bearing surfaces, for the generation of desired musical notes, by a given MIDI device, said device providing an enhanced emulation of the traditional acoustic steelpan, said apparatus comprising:

a main assembly consisting of a playing surface of concave semispherical shape, being mounted upon a main assembly chassis, said playing surface comprising a plurality of note bearing surfaces physically arranged in a plurality of concentric rings, with a plurality of note bearing surfaces per ring;

a main assembly electronic circuit comprising a Main Assembly Interface Circuit, a Main Assembly Embedded Processor, and System Memory;

a light emitting device array (LEDA) comprising a plurality of said note bearing surfaces, each such note bearing surface having a light emitting device associated with said note bearing surface; and electronic circuitry, said circuitry taking inputs from said plurality of note bearing surfaces, a plurality of external connectors, as well as at least one control & display console, said external connectors constructed and arranged to receive and transmit MIDI out signals, control signals for said LEDA and signals for said control & display console.

2. The apparatus of claim 1, wherein said note bearing surfaces include integrated electronics to trigger the generation of notes and comprising at least one note bearing surface frame, at least one note bearing surface shell and a plurality of vibration absorbing mounts, said plurality of vibration absorbing mounts providing acoustic isolation from air borne and structure borne sources, thereby reducing the risk of accidental triggering of said note bearing surface electronics and which are arranged in a plurality of at least three concentric rings, of a plurality of at least twelve note bearing surfaces per ring.

3. The apparatus according to claim 1, comprising a playing surface with a maximum depth of at least 7.5 inches and up to 10 inches and a width from at least 18 inches and up to 26 inches.

4. The apparatus according to claim 2, wherein a player can change the arrangement of notes generated by said note bearing surfaces, allowing the player to customize the layout of said notes through the assignment of said notes to each such note bearing surface.

5. The apparatus according to claim 1, wherein a given player can assign separate voices to one or more of said concentric rings, thus permitting said player to simultaneously access a plurality of at least two separate voices and to play lead and background simultaneously.

6. The apparatus according to claim 1, wherein the electric circuitry allows for variations in sensitivity on a plurality of note bearing surfaces, thus allowing a player to effect play with a plurality of fingers at high sensitivity settings or more aggressively with a given plurality of pan sticks at lower sensitivity levels.

7. The apparatus according to claim 1, wherein the apparatus allows for a plurality of at least ten (10)-note polyphony, and whereby a plurality of said notes may be played simultaneously.

8. The apparatus according to claim 1, wherein the note bearing surfaces have a size, color, or shape, and wherein the size, color, or shape is alterable by the player to provide a visual cue of notes which have been assigned to said plurality of individual note bearing surfaces, said plurality of note bearing surfaces capable of being struck to produce a plurality of desired notes, said plurality of notes being arranged in concentric circles.

9. The apparatus according to claim 1, wherein said playing surface is constructed from a material selected from the group consisting of wood, plastics, fiberglass, composites, and metal.

10. The apparatus according to claim 1, wherein each note bearing surface can trigger a combination of voices all at the note pitch assigned to said note bearing surface.

11. The apparatus according to claim 1, wherein each note bearing surface includes a multi-note or chord capability, whereby at least one of each such note bearing surfaces can trigger a combination of notes all at the voice assigned to said note bearing surface.

12. The apparatus of claim 2, further comprising pressure sensors which generate a MIDI control message when depressing a mallet or stick upon said note bearing surface.

13. The apparatus according to claim 1, wherein each said light emitting device on the playing surface note bearing surface is lit when said respective note bearing surface is to be struck, as determined by the MIDI sequence in a stream originating from an external source, being a MIDI sequence stored on said apparatus or from the MIDI sequence generated, as said apparatus is played, thus facilitating the teaching of music.

14. The apparatus of claim 1, further comprising a plurality of virtual preset touch pads, said virtual preset pads when activated, triggering the operating software to configure said apparatus with a set of features as pre-selected and assigned to said plurality of virtual preset pads.

15. The apparatus of claim 1, further comprising at least one mounting stand including a docking station to provide mains driven power, MIDI and general network connectivity for said apparatus through a detachable connector pod, said power supplied through said connector pod being also used to recharge at least one battery unit in said main assembly of said apparatus.

16. The apparatus according to claim 6, wherein variations in note bearing surface sensitivity is facilitated by the removal or retention of a plurality of impact filter pads on a plurality of note bearing surfaces, thus allowing any given player to effect play with a plurality of fingers, at high sensitivity settings when said plurality of impact filter pads are removed, or more aggressively with a given plurality of pan sticks at lower sensitivity levels, when said plurality of impact filter pads are retained.

17. The apparatus of claim 15, wherein said mounting stand includes at least one rechargeable battery unit and wireless MIDI communication, both of which facilitate performance in a fully portable mode, while in motion, when said apparatus is supported from the neck using a strap, or from the torso using a suitably designed brace.

18. An Apparatus for Percussive Harmonic Musical Synthesis utilizing electronics to generate melodic sound, bearing tone and note pitch, by the striking of a plurality of note bearing surfaces, for the generation of desired musical notes, by a given MIDI device, said device providing an enhanced emulation of the traditional acoustic steelpan, said apparatus comprising:

a main assembly comprising a playing surface, said playing surface comprising a plurality of note bearing surfaces, each note bearing surface being assigned a musical note and further comprising a primary strike zone and one or more secondary strike zones;

each primary strike zone configured to transmit a first electrical signal when said primary strike zone is struck, and each secondary strike zone configured to transmit a second electrical signal when said secondary strike zone is struck, the level of each electrical signal corresponding to the velocity of the strike and the location of the strike within each corresponding strike zone; and electronic circuitry for receiving said first and second electrical signals, said electronic circuitry configured to distinguish between said first and second electrical signals, and transmit MIDI messages having a note value harmonically related to the musical note associated with the note bearing surface transmitting the electrical signal and a velocity value corresponding to the level of each electrical signal.

19. The apparatus of claim 18, wherein said note value of the MIDI message transmitted as the result of a strike in said primary strike zone is the musical note assigned to the note bearing surface, and said note value of the MIDI message transmitted as the result of a strike in said secondary strike zone is a second or third harmonic of the note associated with the note bearing surface.

20. The apparatus of claim 19, wherein said electronic circuitry can scale the velocity value of said MIDI message that is the result of a strike in the secondary strike zone relative to the velocity value of said MIDI message that is the result of a strike in the primary strike zone.

21. The apparatus of claim 18, wherein said plurality of secondary strike zones overlap said primary strike zone.

* * * * *